US010151238B2

(12) United States Patent
Mukohara

(10) Patent No.: US 10,151,238 B2
(45) Date of Patent: Dec. 11, 2018

(54) INTERNAL COMBUSTION ENGINE FOR SADDLE-RIDE TYPE VEHICLE

(71) Applicant: HONDA MOTOR CO., LTD., Tokyo (JP)

(72) Inventor: Hodaka Mukohara, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 139 days.

(21) Appl. No.: 15/453,186

(22) Filed: Mar. 8, 2017

(65) Prior Publication Data

US 2017/0284288 A1 Oct. 5, 2017

(30) Foreign Application Priority Data

Mar. 30, 2016 (JP) ..... 2016-069485

(51) Int. Cl.
*F02F 7/00* (2006.01)
*F02B 61/02* (2006.01)
(Continued)

(52) U.S. Cl.
CPC ..... *F02B 61/02* (2013.01); *F01L 1/047* (2013.01); *F01L 1/053* (2013.01); *F01L 1/18* (2013.01);
(Continued)

(58) Field of Classification Search
CPC ..... F01L 2001/0535; F01L 1/181; F01L 1/46; F02B 75/22; F02F 1/24; F02F 7/0012;
(Continued)

(56) References Cited

U.S. PATENT DOCUMENTS 8,225,761 B2 * 7/2012 Cho ..... F01L 1/267 123/90.16
2002/0046719 A1 * 4/2002 Nomura ..... F01L 1/022 123/90.22

(Continued)

FOREIGN PATENT DOCUMENTS

JP 5378091 B2 12/2013
WO WO 2007/083224 A2 7/2007

OTHER PUBLICATIONS

Bocchiaro, "2005 Victory Vegas—Big Bore Engine Kit," XP-002772993, http://www.baggersmag.com/2005-victory-vegas-big-bore-engine-kit, Feb. 24, 2009, pp. 1-19 (20 pages total).

(Continued)

*Primary Examiner* — Jorge Leon, Jr.
(74) *Attorney, Agent, or Firm* — Birch, Stewart, Kolasch & Birch, LLP

(57) ABSTRACT

An internal combustion engine for a motorcycle includes a rear cylinder head, the rear cylinder head being provided with a camshaft, an exhaust rocker arm rocked by the camshaft, an engine valve closed/opened by being push-pressed by the exhaust rocker arm, and a rocker arm shaft swingably supporting the exhaust rocker arm. In the internal combustion engine for the motorcycle, the rear cylinder head is provided separately from a holder member, the holder member being provided adjacently to the rear cylinder head, the camshaft is rotatably supported by the holder member, and the holder member is provided with right and left rear side walls and internal combustion engine supporting portions, the right and left rear side walls supporting the rocker arm shaft, the internal combustion engine supporting portion being supported by a vehicle body frame.

15 Claims, 15 Drawing Sheets

(51) Int. Cl.

| | |
|---|---|
| ***F01L 1/047*** | (2006.01) |
| ***F02B 75/22*** | (2006.01) |
| ***F02F 1/24*** | (2006.01) |
| *F01L 1/46* | (2006.01) |
| *F01L 1/18* | (2006.01) |
| *F01L 1/053* | (2006.01) |
| *F02F 11/00* | (2006.01) |

(52) U.S. Cl.
CPC ..... *F02B 75/22* (2013.01); *F02F 1/24* (2013.01); *F02F 7/0082* (2013.01); *F01L 1/181* (2013.01); *F01L 1/46* (2013.01); *F01L 2001/0476* (2013.01); *F01L 2001/0535* (2013.01); *F01L 2001/0537* (2013.01); *F02F 7/0012* (2013.01); *F02F 7/0046* (2013.01); *F02F 7/0068* (2013.01); *F02F 11/002* (2013.01); *F02F 2007/0063* (2013.01)

(58) Field of Classification Search
CPC .. F02F 7/0046; F02F 7/006; F02F 2007/0063; F02F 7/0068; F02F 7/0082; F02F 11/002
USPC ..... 123/90.27, 90.39, 90.44
See application file for complete search history.

(56) References Cited

U.S. PATENT DOCUMENTS

| | | | | |
|---|---|---|---|---|
| 2004/0103871 | A1 | 6/2004 | Tsutsumi et al. | |
| 2009/0101096 | A1* | 4/2009 | Ochiai ..... | F01L 1/053 123/90.27 |
| 2009/0241891 | A1* | 10/2009 | Tsubakino ..... | F01L 1/022 123/193.5 |
| 2010/0126459 | A1 | 5/2010 | Tawarada et al. | |
| 2010/0242885 | A1* | 9/2010 | Tabinoki ..... | F01L 1/022 123/90.31 |
| 2011/0239987 | A1* | 10/2011 | Maehara ..... | F01L 1/181 123/406.46 |
| 2013/0298858 | A1* | 11/2013 | Ichi ..... | F01L 1/053 123/90.44 |

OTHER PUBLICATIONS

Extended European Search Report issued in European Application No. 17159275.1 dated Aug. 28, 2017.

* cited by examiner

INTERNAL COMBUSTION ENGINE FOR SADDLE-RIDE TYPE VEHICLE

The present application claims priority under 35 U.S.C. § 119 to Japanese Patent Application No. 2016-069485 filed on Mar. 30, 2016. The content of the application is incorporated herein by reference in its entirety.

TECHNICAL FIELD

The present invention relates to an internal combustion engine for a saddle-ride type vehicle.

BACKGROUND ART

The existing internal combustion engine is known (for example, see Patent Literature 1). The existing internal combustion engine is configured in such a manner that portions are formed in a splittable (separable) manner, the portions supporting a camshaft and a rocker arm shaft by a cylinder head of the internal combustion engine.

CITATION LIST

Patent Literature

[Patent Literature 1] JP Patent No. 5378091

SUMMARY OF INVENTION

Technical Problem

Patent Literature 1 does not disclose how to mount the internal combustion engine in a vehicle body. However, in the saddle-ride type vehicle, a vehicle body space is limited in comparison with an automobile including a passenger compartment. For this reason, an internal combustion engine for a saddle-ride type vehicle taking assemblability and productivity into consideration is required.

An object of the present invention is to provide an internal combustion engine for a saddle-ride type vehicle configured to improve the assemblability and the productivity.

Solution to Problem

In order to address the above-described problem, according to an aspect of the present invention, there is provided an internal combustion engine for a saddle-ride type vehicle the internal combustion engine including a cylinder head (97), the cylinder head (97) being provided with a camshaft (104), a rocker arm (107) rocked by the camshaft (104), an engine valve (166) closed/opened by being push-pressed by the rocker arm (107), and a rocker arm shaft (108) swingably supporting the rocker arm (107). In the internal combustion engine for the saddle-ride type vehicle, the cylinder head (97) is provided separately from a holder member (98), the holder member (98) being provided adjacently to the cylinder head (97), the camshaft (104) is rotatably supported by the holder member (98), and the holder member (98) is provided with a rocker arm shaft supporting portion (152*u*) and an internal combustion engine supporting portion (152*a*), the rocker arm shaft supporting portion (152*u*) supporting the rocker arm shaft (108), the internal combustion engine supporting portion (152*a*) being supported by a vehicle body frame (11).

In the above-described structure, the internal combustion engine supporting portion (152*a*) may be provided to extend outward in a vehicle width direction, and the internal combustion engine supporting portion (152*a*) may be fastened to the vehicle body frame (11) from the outside in the vehicle width direction toward the inside in the vehicle width direction by a fastening member (86).

Also, in the above-described structure, a crankcase (81) may be provided below the cylinder head (97), and the crankcase (81) may be provided with a shock absorber upper end supporting portion hereinafter referred to as a cushion upper end supporting portion (81*a*) supporting an upper end of a shock absorber unit hereinafter referred to as a cushion unit (123) through a bracket (172).

Also, in the above-described structure, the crankcase (81) may be cut in half in the vehicle width direction, and the shock absorber upper end supporting portion or cushion upper end supporting portion (81*a*) may be provided to one of right and left crankcases (81R, 81L).

Also, in the above-described structure, an exhaust pipe (68) may be connected to a rear portion of the cylinder head (97), and the exhaust pipe (68) may extend rearward of the other of the right and left crankcases (81R, 81L).

Also, in the above-described structure, the internal combustion engine (31) may be a V-type internal combustion engine including a front bank (31A) and a rear bank (31B), and the cylinder head (97) and the shock absorber upper end supporting portion or cushion upper end supporting portion (81*a*) may be provided to the rear bank (31B).

Also, in the above-described structure, a supercharger (63) may be arranged between the front bank (31A) and the rear bank (31B).

Also, in the above-described structure, the internal combustion engine supporting portion (152*a*) may be provided at a rear end of the holder member (98), and the upper end of the cushion unit (123) may be arranged immediately below the internal combustion engine supporting portion (152*a*).

Advantageous Effects of Invention

In the aspect of the present invention, the holder member is provided separately from the cylinder head and the holder member is provided adjacently to the cylinder head. The camshaft is rotatably supported by the holder member. The holder member is provided with the rocker arm shaft supporting portion supporting the rocker arm shaft and the internal combustion engine supporting portion supporting the internal combustion engine by the vehicle body frame. In the internal combustion engine for the saddle-ride type vehicle having the limited vehicle body space in comparison with the automobile, the holder member is provided separately from the cylinder head. For this reason, the cylinder head can be formed into a simple shape by displacing to the holder member the camshaft supporting portion, the rocker arm shaft supporting portion and the internal combustion engine supporting portion, the camshaft supporting portion and the rocker arm shaft supporting portion being provided to the cylinder head of the existing internal combustion engine, the internal combustion engine supporting portion being provided to the internal combustion engine. Also, the holder member is provided only with the camshaft supporting portion, the rocker arm shaft supporting portion, the internal combustion supporting portion and the like. As a result, the structure of the holder member is prevented from being complicated, and the holder member can be easily formed. Also, the holder member can be configured to effectively use the vehicle body space. In view of this, the assemblability of the cylinder head and the productivity of the cylinder head and the holder member and, eventually, the assemblability and the productivity of the internal combustion engine can be improved.

Also, the internal combustion engine supporting portion is provided to extend outward in the vehicle width direction, and the internal combustion engine supporting portion is fastened to the vehicle body frame from the outside in the vehicle width direction toward the inside in the vehicle width direction by the fastening member. For this reason, the internal combustion engine supporting portion can be fastened to the vehicle body frame from the outside in the vehicle width direction, and the assemblability of the internal combustion engine with respect to the vehicle body frame can be improved.

Also, the crankcase is provided below the cylinder head, and the crankcase is provided with the cushion upper end supporting portion supporting the upper end of the cushion unit through the bracket. For this reason, the cushion unit can be supported by effectively using the vehicle body space around the internal combustion engine.

Also, the crankcase is cut in half in the vehicle width direction, and the cushion upper end supporting portion is provided to one of right and left crankcases. The known internal combustion engine is configured in such a manner that the cushion upper end supporting portions are provided on both the right and left sides of the crankcases cut in half in the vehicle width direction, and the known internal combustion engine has the advantage that the cushion unit supporting portion can be arranged in the center of the vehicle body. However, dimensional control when assembling the cushion unit to the cushion upper end supporting portion becomes difficult. On the other hand, by providing the cushion upper end supporting portion to one of the crankcases cut in half in the vehicle width direction, the dimensional control when assembling the cushion unit can be easily performed, and also the vehicle body space of the other of the crankcases cut in half in the vehicle width direction can be effectively used.

Also, the exhaust pipe is connected to the rear portion of the cylinder head, and the exhaust pipe extends rearward of the other of the right and left crankcases. For this reason, the cushion unit is coupled to the cushion upper end supporting portion of one of the crankcases cut in half in the vehicle width direction, and the exhaust pipe passes behind the other of the crankcases cut in half in the vehicle width direction. As a result, the space around the internal combustion engine for the saddle-ride type vehicle having the limited vehicle body space can be effectively used.

Also, the internal combustion engine is a V-type internal combustion engine including the front bank and the rear bank. The cylinder head and the cushion upper end supporting portion are provided to the rear bank. For this reason, when the upper end of the cushion unit is attached to the cushion upper end supporting portion, a lower end of the cushion unit can be easily attached to a side of a rear wheel, and the assemblability of the cushion unit can be improved.

Also, the supercharger is arranged between the front bank and the rear bank. For this reason, the space around the internal combustion engine for the saddle-ride type vehicle having the limited vehicle body space can be effectively used.

Also, the internal combustion engine supporting portion is provided at the rear end of the holder member, and the upper end of the cushion unit is arranged immediately below the internal combustion engine supporting portion. For this reason, by arranging the internal combustion engine supporting portion in the vehicle body space behind the cylinder head, effective use can be achieved. Also, the upper end of the cushion unit is arranged immediately below the internal combustion engine supporting portion. For this reason, the stroke of the cushion unit can be further increased, and vehicle riding comfortableness can be improved.

DESCRIPTION OF EMBODIMENTS

An embodiment of the present invention will be described below with reference to drawings. Note that in the explanation, description of directions such as front and rear, right and left, and upper and lower is the same direction with respect to a vehicle body unless otherwise specially described. Also note that in the respective drawings, a reference sign FR is indicative of a front side of the vehicle body, a reference sign UP is indicative of an upper side of the vehicle body, and a reference sign LH is indicative of a left side of the vehicle body.

Figure 1:
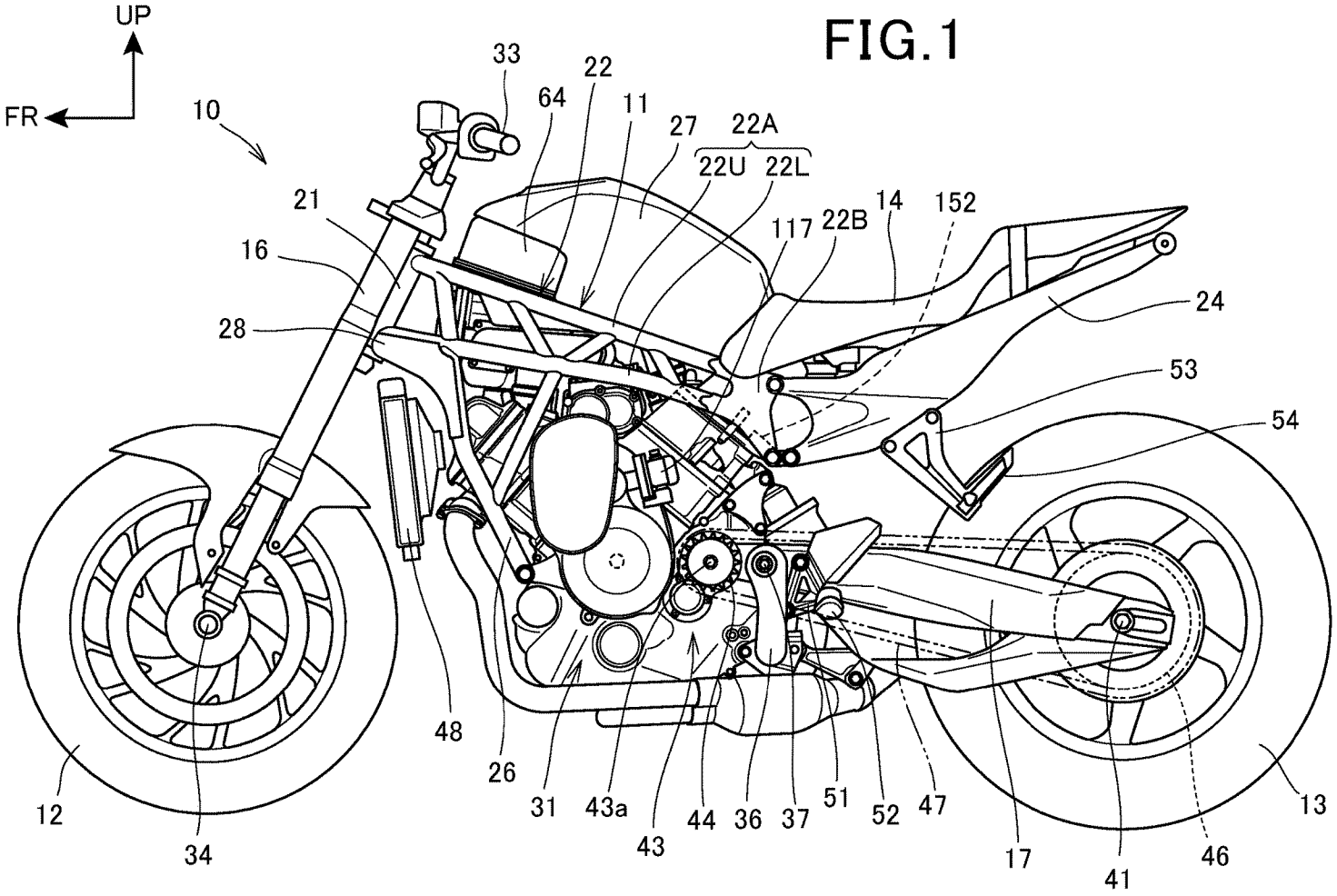
FIG. 1 is a left side view of a motorcycle mounted with an internal combustion engine according to the present invention.

FIG. 1 is a left side view of a motorcycle 10 mounted with an internal combustion engine 31 according to the present invention.

The motorcycle 10 is a saddle-ride type vehicle including a vehicle body frame 11, a front wheel 12, a rear wheel 13, and a seat 14.

The front wheel 12 is supported at a front end of the vehicle body frame 11 as a framework through a front fork 16. The rear wheel 13 is supported by a center lower portion of the vehicle body frame 11 through a swing arm 17. The seat 14 is attached to an upper rear portion of the vehicle body frame 11.

The vehicle body frame 11 is provided with a head pipe 21, a pair of right and left main frames 22, a seat frame 24, and a pair of right and left down frames 26.

The right and left main frames 22 are configured with right and left pipe frame portions 22A and a pair of right and left rear end frame portions 22B, the right and left pipe frame portions 22A being configured in such a manner that two pipe members 22U, 22L extend rearward and downward to the rear from the head pipe 21, the pair of right and left rear end frame portions 22B being attached to rear ends of the right and left pipe frame portions 22A. The two pipe members 22U, 22L are arranged at a distance in a vertical direction, and the pipe members 22U, 22L are connected to each other through a plurality of reinforcing pipes. A fuel tank 27 is mounted on an upper portion of the right and left main frames 22.

The seat frame 24 has an upper portion and a lower portion of a front end, the upper portion and the lower portion being connected to right and left rear end frame portions 22B of the main frames 22. The seat frame 24 extends rearward and upward from the rear end frame portions 22B, and the seat frame 24 supports the seat 14 located adjacently behind the fuel tank 27.

The right and left down frames 26 extend respectively downward from the front portions of the right and left lower pipe members 22L. The upper portions of the down frames 26 are connected to the head pipe 21 together with front portions of the pipe members 22L through a reinforcing member 28.

The right and left down frames 26 support the internal combustion engine 31 together with the right and left main frames 22 (detailedly, the right and left rear end frame portions 22B).

The front fork 16 is steerably supported by the head pipe 21. A handlebar 33 is supported at an upper end of the front fork 16, and a front wheel 12 is supported at a lower end of the front fork 16 through an axle 34.

A pivot supporting member 36 is attached to a lower portion of the internal combustion engine 31, and the swing arm 17 is vertically swingably supported by a pivot shaft 37 provided to the pivot supporting member 36.

The rear wheel 13 is supported at a rear end of the swing arm 17 through an axle 41.

The internal combustion engine 31 has a rear portion provided integrally with a transmission 43. A chain 47 is laid along a drive sprocket 44 and a driven sprocket 46, the drive sprocket 44 being fitted around an output shaft 43*a* of the transmission 43, the driven sprocket 46 being provided integrally with the rear wheel 13.

A radiator 48 configuring a cooling system for the internal combustion engine 31 is arranged ahead of the internal combustion engine 31. A rider step 52 is attached to the pivot supporting member 36 through a bracket 51. A pillion passenger step 54 is attached to a lower portion of the seat frame 24 through a bracket 53.

Figure 2:
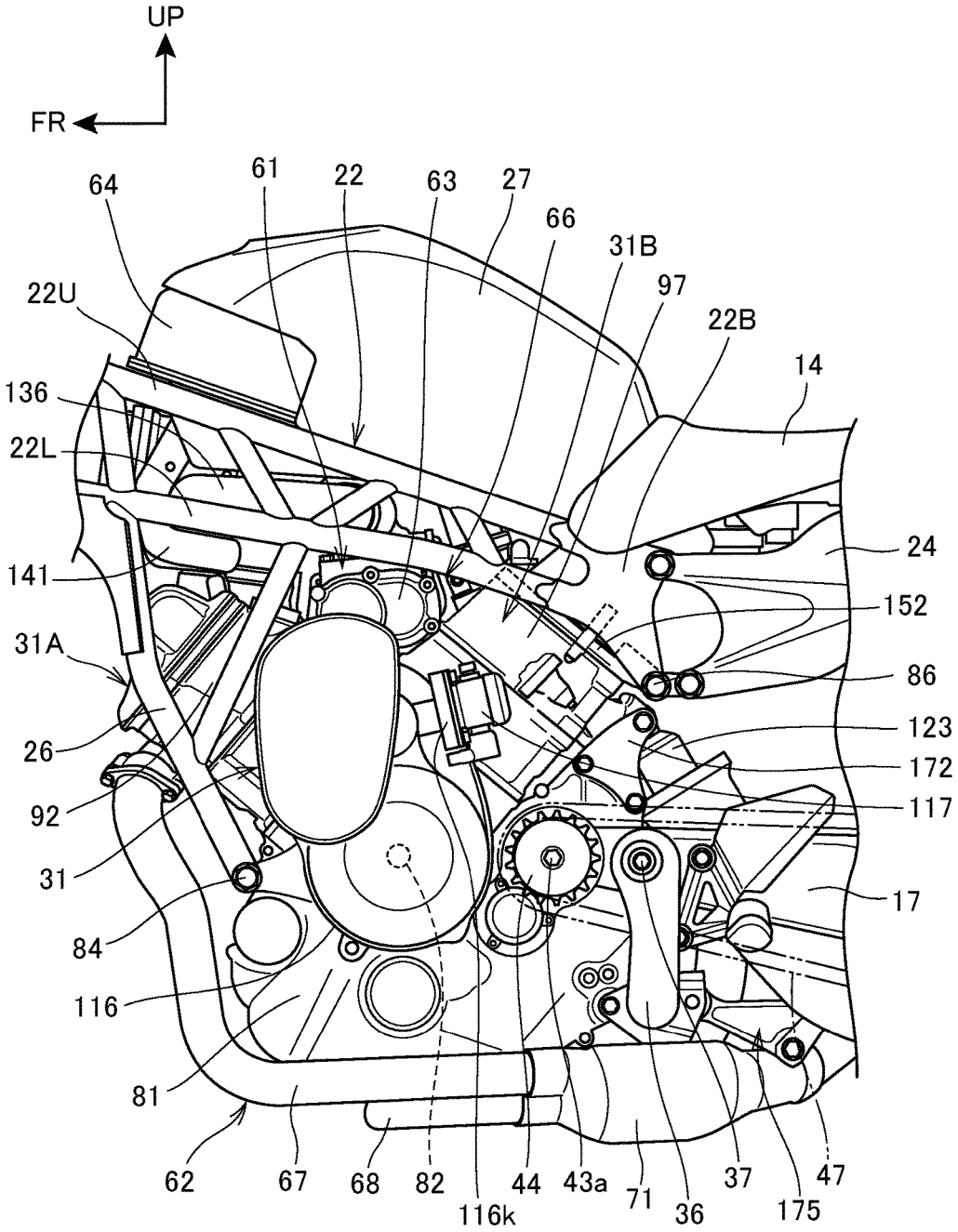
FIG. 2 is a left side view of a main section showing the motorcycle.

FIG. 2 is a left side view of a main section showing the motorcycle 10.

The internal combustion engine 31 is a V-type internal combustion engine including a front bank 31A and a rear bank 31B, and the internal combustion engine 31 is configured as a direct injection internal combustion engine directly injecting fuel into combustion chambers respectively provided to the front bank 31A and the rear bank 31B. The front bank 31A and the rear bank 31B extend obliquely forward and obliquely rearward in a V-shaped manner from an upper portion of the crankcase 81 provided to a lower portion of the internal combustion engine 31.

An intake device 61 is connected to a rear surface of the front bank 31A and a front surface of the rear bank 31B. An exhaust system 62 is connected to a front portion of the front bank 31A and a rear portion of the rear bank 31B.

The intake device 61 includes a supercharger 63 and an air cleaner 64, the supercharger 63 being driven by power from a crankshaft 82 stored in the crankcase 81 of the internal combustion engine 31, the air cleaner 64 being arranged upstream of the supercharger 63.

The supercharger 63 is arranged in a space 66 formed between the rear surface of the front bank 31A and the front surface of the rear bank 31B. The air cleaner 64 is attached to the main frames 22 in order to be positioned between the front portions of the main frames 22 and a front portion of the fuel tank 27. In the embodiment, although the air cleaner 64 is partially exposed to the front side of a vehicle and a lateral side of the vehicle, the air cleaner 64 may be stored inside of a cover (unillustrated) included in the vehicle body, and the air cleaner 64 also may be covered with the cover.

The internal combustion engine 31 is attached in such a manner that the front portion of the crankcase 81 is attached to the lower ends of the right and left down frames 26 by bolts 84 respectively, and the upper portion of the rear bank 31B is fastened from the outside in the vehicle width direction to the lower ends of the rear end frame portions 22B of the main frames 22 by bolts 86.

The exhaust system 62 includes a front exhaust pipe 67, a rear exhaust pipe 68 (see FIG. 4), and a catalytic device 71, the front exhaust pipe 67 extending downward and rearward from the front bank 31A, the rear exhaust pipe 68 extending rearward and downward from the rear bank 31B, the catalytic device 71 as a collecting portion connected to respective rear ends of the front exhaust pipe 67 and the rear exhaust pipe 68.

An exhaust pipe configuring the exhaust system 62 is connected to a rear end of the catalytic device 71. A muffler configuring the exhaust system 62 is connected to a rear end of the exhaust pipe.

Figure 3:
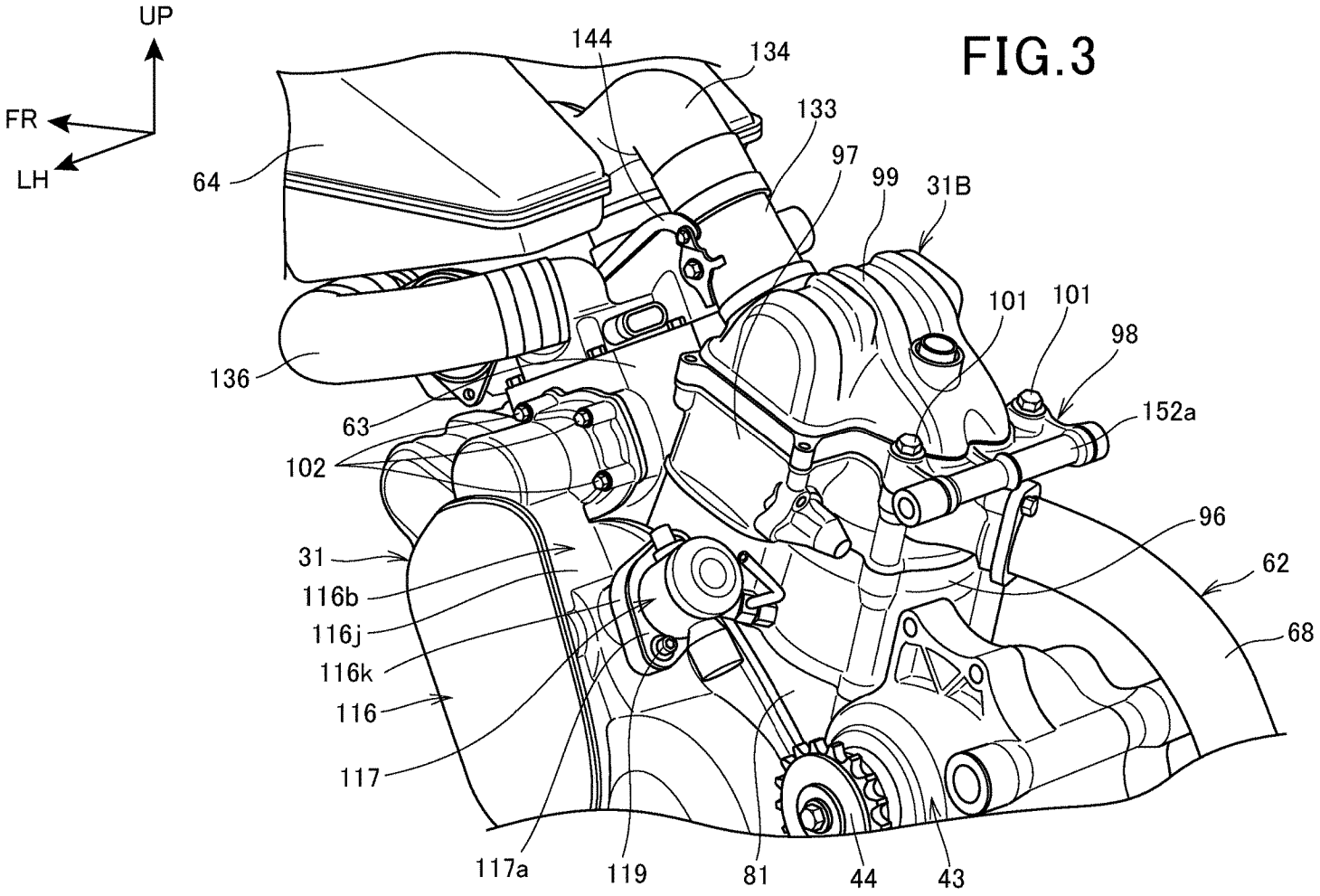
FIG. 3 is a perspective view showing the internal combustion engine and a periphery thereof.

FIG. 3 is a perspective view showing the internal combustion engine 31 and a periphery thereof, and FIG. 3 is a view when the internal combustion engine 31 is viewed from an obliquely rear side.

The internal combustion engine 31 has the rear bank 31B including a rear cylinder block 96, a rear cylinder head 97, a holder member 98, and a rear head cover 99. The rear cylinder block 96, the rear cylinder head 97, the holder member 98, and the rear head cover 99 are placed on a rear upper portion of the crankcase 81 in order to overlap with each other sequentially.

The rear cylinder block 96, the rear cylinder head 97, and the holder member 98 are fastened to the crankcase 81 by a plurality of bolts 101. The rear head cover 99 is fixed to the rear cylinder head 97 or the holder member 98 by unillustrated bolts different from the bolts 101.

The rear exhaust pipe 68 is connected to a rear portion of the rear cylinder head 97. The holder member 98 is arranged between the rear cylinder head 97 and the rear head cover 99. An internal combustion engine supporting portion 152*a* is provided at a rear end of the holder member 98. The internal combustion engine supporting portion 152*a* is supported by the rear end frame portions 22B (see FIG. 2) of the main frames 22 (see FIG. 2).

A left portion of the supercharger 63 is attached to a supercharger supporting portion 116*a* by a plurality of bolts 102, the supercharger supporting portion 116*a* being formed integrally with an upper portion of the case cover 116.

Figure 4:
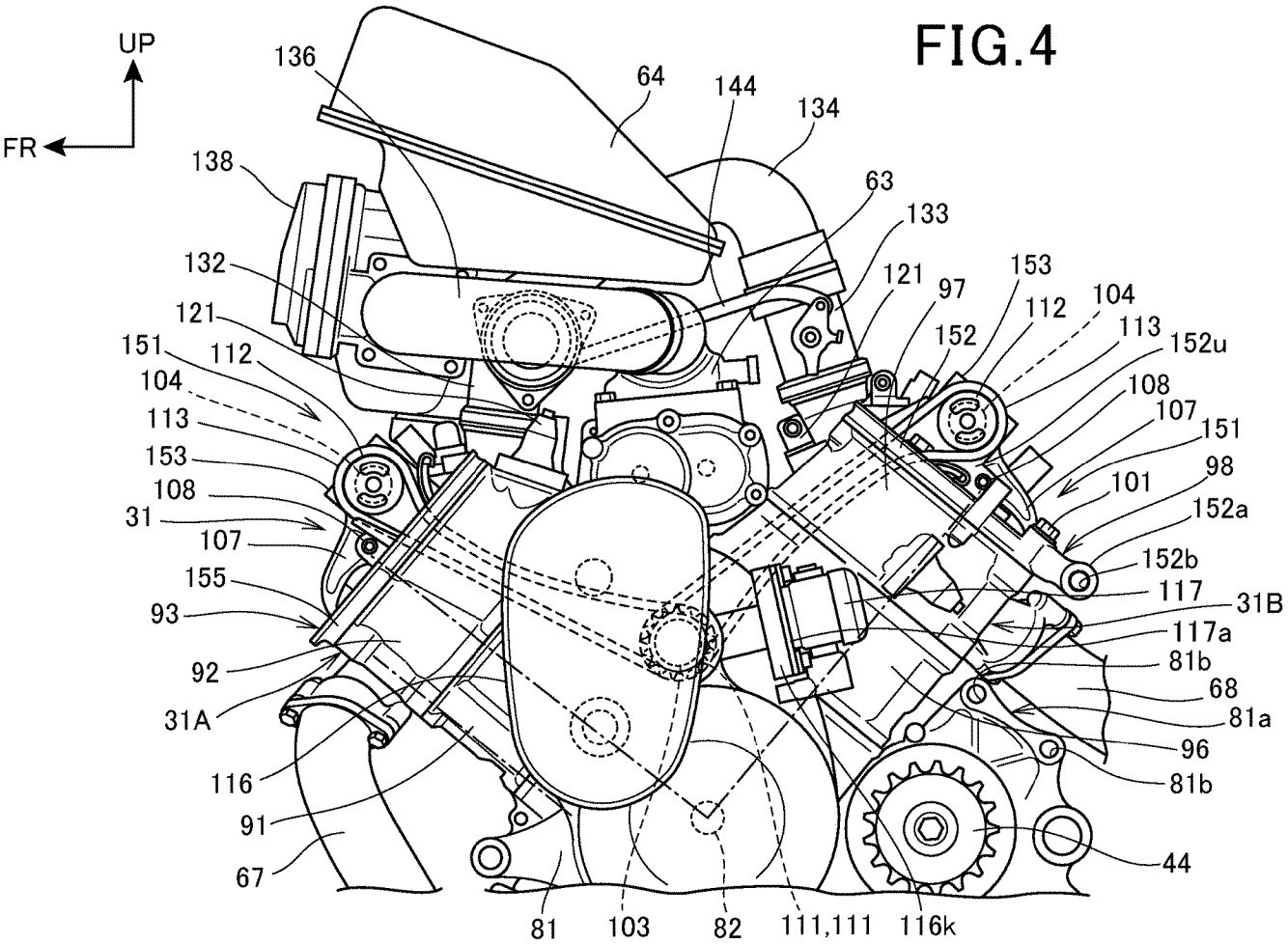
FIG. 4 is a left side view of a main section showing the internal combustion engine.

FIG. 4 is a left side view of a main section showing the internal combustion engine 31.

The internal combustion engine 31 has the front bank 31A including a front cylinder block 91, a front cylinder head 92, a spacer member 93, and the front head cover 94 (see FIG. 2). The front cylinder block 91, the front cylinder head 92, the spacer member 93, and the front head cover 94 are placed on a front upper portion of the crankcase 81 in order to overlap with each other sequentially.

A drive shaft 103 arranged above the crankshaft 82 is rotatably supported by the crankcase 81. The drive shaft 103 is arranged in parallel with the crankshaft 82.

The spacer member 93 is arranged between the front cylinder head 92 and the front head cover 94. A camshaft 104 arranged in parallel with the crankshaft 82 is rotatably supported by the spacer member 93. Also, a rocker arm shaft 108 for supporting an exhaust rocker arm 107 is attached to the spacer member 93.

The exhaust rocker arm 107 is driven by an exhaust cam (not shown) provided to the camshaft 104. Also, the exhaust rocker arm 107 drives an exhaust engine valve 166 (see FIG. 11) for opening/closing exhaust ports opened in the combustion chambers formed between the front cylinder block 91 and the front cylinder head 92.

Also, the camshaft 104 is provided with an intake cam (not shown). An intake engine valve 164 (see FIG. 11) for opening/closing intake ports opened in the combustion chambers is directly driven by the intake cam.

The drive shaft 103 is attached with a pair of drive sprockets 111, 111, and the camshaft 104 is attached with a cam sprocket 112. A cam chain 113 is laid between one of the drive sprockets 111, 111 and the cam sprocket 112.

The internal combustion engine 31 has the rear bank 31B including the rear cylinder block 96, the rear cylinder head 97, the holder member 98, and the rear head cover 99. The rear cylinder block 96, the rear cylinder head 97, the holder member 98, and the rear head cover 99 are placed on the rear upper portion of the crankcase 81 in order to overlap with each other sequentially.

The camshaft 104 arranged in parallel with the crankshaft 82 is rotatably supported by the holder member 98. Also, in the same way as the spacer member 93, a rocker arm shaft 108 for supporting the exhaust rocker arm 107 is attached to the holder member 98.

In the same way as the front bank 31A, the cam sprocket 112 is attached to the camshaft 104, and the cam chain 113 is laid between the cam sprocket 112 and the other of the drive sprockets 111, 111 attached to the drive shaft 103.

The case cover 116 is attached to one surface (left surface) of the crankcase 81, and a plurality of gears and the like for transmitting power from the crankshaft 82 to the drive shaft 103 is covered with the case cover 116. The case cover 116 is provided with a supercharger supporting portion 116*a* for covering a left portion of the supercharger 63 and also supporting the left portion.

A high-pressure fuel pump 117 activated by using power of the drive shaft 103 (that is, power of the crankshaft 82) is supported by the rear portion of the case cover 116.

The high-pressure fuel pump 117 is driven by a cam lobe (a substantially oval-shaped cross-sectional portion having a cam crest) provided to the drive shaft 103. Fuel pressurized by the high-pressure fuel pump 117 is injected into the combustion chambers through fuel injection valves 121 respectively provided in the front cylinder head 92 and the rear cylinder head 97.

In FIG. 3 and FIG. 4, the case cover 116 has a rear wall 116*j* of a gear storage portion 116*b*, the rear wall 116*j* being formed integrally with a pump pedestal portion 116*k*. A platelike flange portion 117*a* provided to the high-pressure fuel pump 117 is fastened to the pump pedestal portion 116*k* by a pair of bolts 119. As a result, the high-pressure fuel pump 117 is fixed to the case cover 116.

The rear upper portion of the crankcase 81 behind the rear bank 31B is formed with an upwardly protruding cushion upper end supporting portion 81*a* for supporting an upper end of a cushion unit 123 (see FIG. 2). Mounting holes 81*b*, 81*b* are longitudinally opened respectively in the cushion upper end supporting portion 81*a*.

Figure 5:
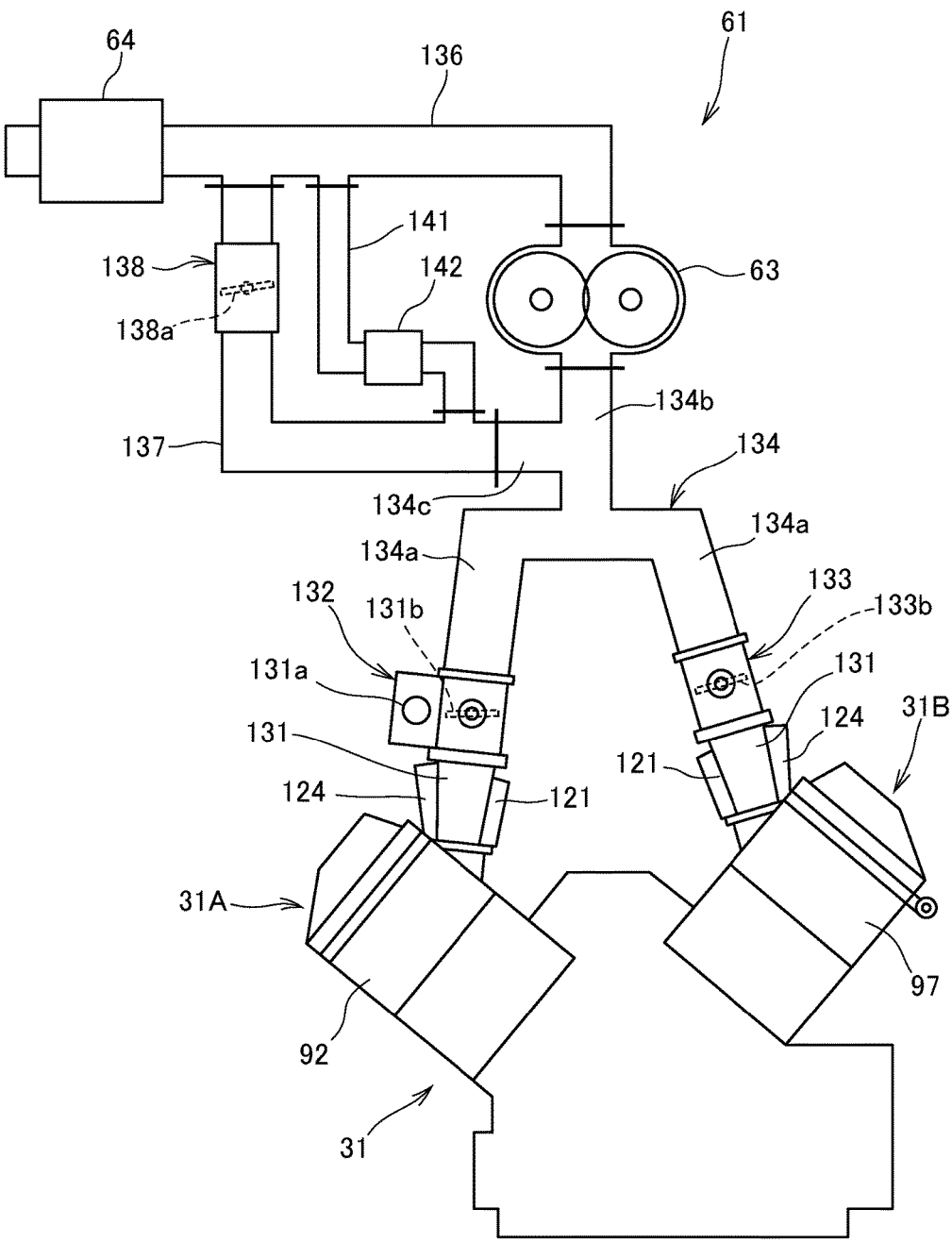
FIG. 5 is a pattern diagram showing an intake device connected to the internal combustion engine.

FIG. 5 is a pattern diagram showing the intake device 61 connected to the internal combustion engine 31.

The intake device 61 includes intake pipes 131, 131, a TBW throttle device 132, a throttle device 133, fuel injection valves 121, 121, 124, 124, a downstream connecting tube 134, the supercharger 63, an upstream connecting tube 136, the air cleaner 64, a bypass pipe 137, a bypass valve device 138, a relief pipe 141, and a relief valve 142.

The front cylinder head 92 is connected with the TBW throttle device 132 through the intake pipe 131. The TBW throttle device 132 includes an electric motor 132*a*, and a throttle valve 132*b* driven by the electric motor 132*a*, and the TBW throttle device 132 is one comportment for configuring a TBW as will be described below.

The TBW (Throttle-by-Wire) is a system configured in such a manner that turning movement of a throttle grip provided to the handlebar 33 (see FIG. 1) is detected by a sensor, a sensing signal is transmitted to the electric motor 132*a* through a conductor, and the throttle valve 132*b* is opened/closed by the electric motor 132*a*.

In addition to the fuel injection valve 121 for direct injection, the fuel injection valve 124 for injecting the fuel into the intake pipe 131 is attached to the intake pipe 131 of the front bank 31A.

The rear cylinder head 97 is connected with the throttle device 133 through the intake pipe 131. The throttle device 133 is provided with a throttle valve 133*b* opened/closed in conjunction with the throttle valve 132*b* of the TBW throttle device 132. The throttle valve 132*b* and the throttle valve 133*b* are coupled to each other through a rod 144 (see FIG. 3 and FIG. 4).

In addition to the fuel injection valve 121 for direct injection, the fuel injection valve 124 for injecting the fuel into the intake pipe 131 is attached to the intake pipe 131 of the rear bank 31B.

The TBW throttle device 132 and the throttle device 133 are connected with forked pipe portions 134*a*, 134*a* of the downstream connecting tube 134. Also, one end of the supercharger 63 is connected to the pipe portion 134*b* extending from the collecting portion of the pipe portions 134*a*, 134*a* of the downstream connecting tube 134.

The other end of the supercharger 63 is connected with the air cleaner 64 through the upstream connecting tube 136.

The supercharger 63 is a mechanically driven supercharger (supercharger) configured in such a manner that two shafts and rotors respectively provided to the respective shafts are provided inside of the supercharger 63, power is transmitted to one shaft, the rotors engaged with each other are rotated, and compressed air is delivered. Air supplied from the air cleaner 64 to the supercharger 63 through the upstream connecting tube 136 is compressed by the supercharger 63, and the air is delivered from the supercharger 63 to the downstream connecting tube 134. After that, the air is led to the combustion chambers through the downstream connecting tube 134, the TBW throttle device 132, the throttle device 133, the intake pipes 131, 131, and the respective ports formed in the front cylinder head 92 and the rear cylinder head 97.

The downstream connecting tube 134 is formed with a pipe portion 134*c* extending from the pipe portion 134*b* to the lateral side. The bypass pipe 137 is connected to the pipe portion 134*c* and the upstream connecting tube 136. The bypass valve device 138 is provided in the middle of the bypass pipe 137.

The bypass valve device 138 is a device including a bypass valve 138*a*, the device adjusting supercharging pressure of an output side of the supercharger 63 (a range from the downstream connecting tube 134 to the combustion chambers) by changing an opening of the bypass valve 138*a*.

Also, the relief pipe 141 is connected to the upstream connecting tube 136 and a portion closer to the pipe portion 134*c* than the bypass valve device 138 in the bypass pipe 137. The relief valve 142 is arranged in the middle of the relief pipe 141.

When the supercharging pressure on an output side of the supercharger 63 exceeds a predetermined value, the relief valve 142 releases the pressure from the output side of the supercharger 63 to the input side thereof.

Figure 6:
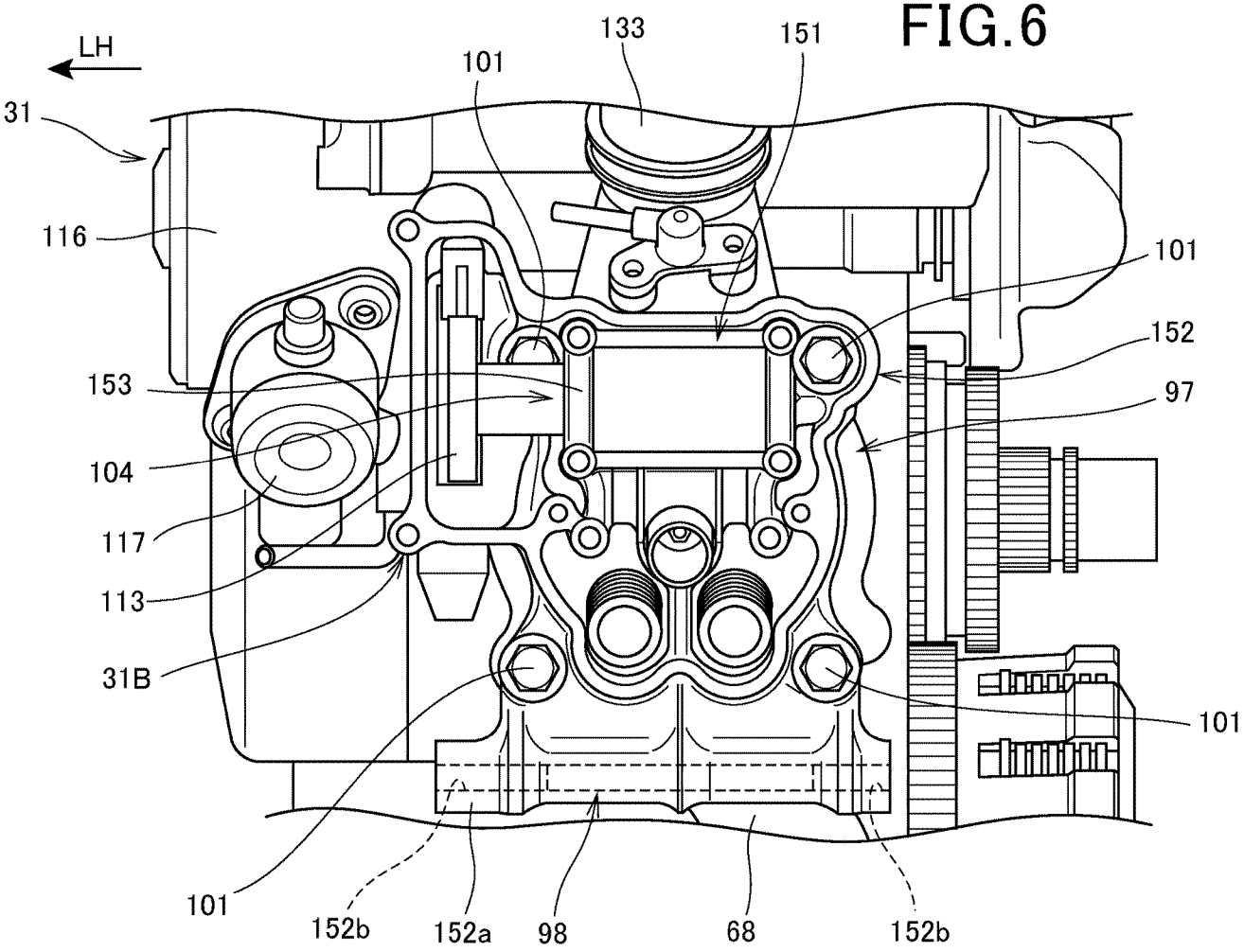
FIG. 6 is a perspective view showing a rear bank of the internal combustion engine and a periphery of the rear bank.

FIG. 6 is a perspective view showing the rear bank 31B of the internal combustion engine 31 and a periphery of the rear bank 31B.

The rear cylinder head 97 is provided with a valve train 151 for opening/closing a pair of intake engine valves 164 (see FIG. 11) and a pair of exhaust engine valves 166 (see FIG. 11).

The valve train 151 (also, see FIG. 4) is provided with the camshaft 104, the pair of exhaust rocker arms 107 (see FIG. 4), and a rocker arm shaft 108 (see FIG. 4).

The camshaft 104 is rotatably supported by the holder member 98.

The holder member 98 is configured with an integrally molded holder body 152 and a cap member 153 as an integrally molded article attached to the holder body 152 by a plurality of bolts. Each of the holder body 152 and the cap member 153 is a workpiece with an aluminum alloy casting machined.

The camshaft 104 is supported by being sandwiched between the holder body 152 and the cap member 153.

The pair of exhaust rocker arms 107 extends in a longitudinal direction in order to be perpendicular to the camshaft 104, the pair of exhaust rocker arms 107 is swingably supported by the rocker arm shaft 108, and the pair of exhaust rocker arms 107 is driven by a pair of exhaust cams formed with respect to the camshaft 104.

The camshaft 104 is provided with an intake cam formed between the pair of exhaust cams. The pair of intake engine valves 164 (see FIG. 11) is directly driven by the intake cam.

The rocker arm shaft 108 is attached to the holder body 152 in order to become parallel to the camshaft 104.

The internal combustion engine supporting portion 152*a* is integrally provided at the rear end of the holder body 152. Ends 152*k*, 152*k* on both sides of the internal combustion engine supporting portion 152*a* are formed with female screws 152*b*, 152*b* screwed around and coupled with the bolts 86 (see FIG. 2) for coupling with the right and left main frames 22 (see FIG. 2).

In FIG. 4, the above-described valve train 151 is also provided to the front cylinder head 92. Note that the camshaft 104 is rotatably supported by the spacer member 93. The spacer member 93 is configured with the spacer body 155 and the cap member 153 attached to the spacer body 155 by the plurality of bolts. The camshaft 104 is supported by being sandwiched between the spacer body 155 and the cap member 153. The rocker arm shaft 108 is attached to the spacer body 155 in order to become parallel to the camshaft 104. The spacer body 155 is a workpiece with the aluminum alloy casting machined.

Figure 7:
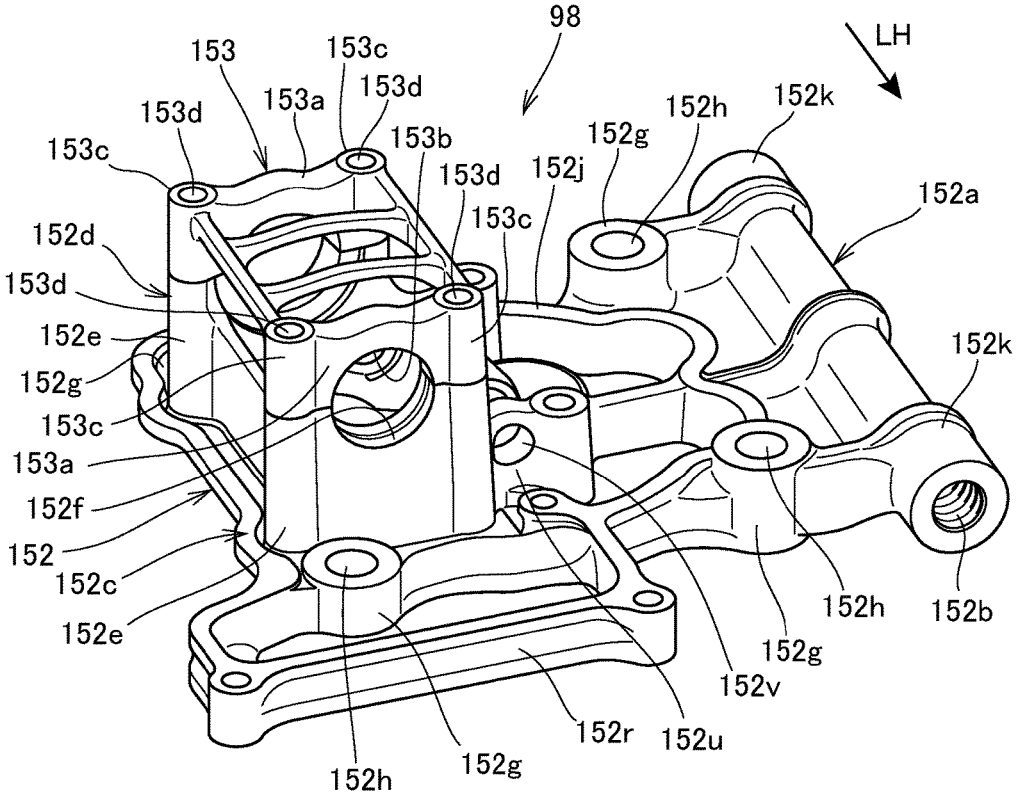
FIG. 7 is a perspective view showing a holder member.

FIG. 7 is a perspective view showing the holder member 98.

The holder body 152 of the holder member 98 is configured with a front holder portion 152*c* and the internal combustion engine supporting portion 152*a*, the front holder portion 152*c* being formed to be arranged along a profile of an upper surface of the rear cylinder head 97 (see FIG. 6), the internal combustion engine supporting portion 152*a* being provided integrally with the rear end of the front holder portion 152*c* in order to extend in the vehicle width direction.

The front holder portion 152*c* is provided with a frame portion 152*j* and a raised portion 152*d*, the frame portion 152*j* forming a profile of the front holder portion 152*c*, the raised portion 152*d* being formed to protrude upward on an inner side of the frame portion 152*j* and in front of the front holder portion 152*c*.

The raised portion 152*d* is a portion for supporting the camshaft 104 (see FIG. 6) together with the cap member 153, and the raised portion 152*d* is provided with side walls 152*e*, 152*e* arranged on both sides of the raised portion 152*d* in the vehicle width direction. The respective side walls 152*e*, 152*e* of the raised portion 152*d* are formed with upwardly opened semicircular notches 152*f*.

Edge portions of the front holder portion 152*c* are formed with a plurality of boss portions 152*g*. Bolt insertion holes 152*h* are opened in the respective boss portions 152*g*. The bolts insertion holes 152*h* are provided to allow passage of the bolts 101 (see FIG. 6) for fastening respective components for the rear bank 31B (see FIG. 4).

The cap member 153 is formed with side walls 153*a*, 153*a* on both sides in the vehicle width direction. The respective side walls 153*a*, 153*a* are formed with downwardly opened semicircular notches 153*b*.

Respective boss portions 153*c* are formed at the respective front and rear ends of the side walls 153*a*, 153*a*. Bolt insertion holes 153*d* for allowing passage of the bolts are opened in the respective boss portions 153*c*. The cap member 153 is fastened to the holder member 98 by the bolts passed through the bolt insertion holes 153*d*.

Figure 8:
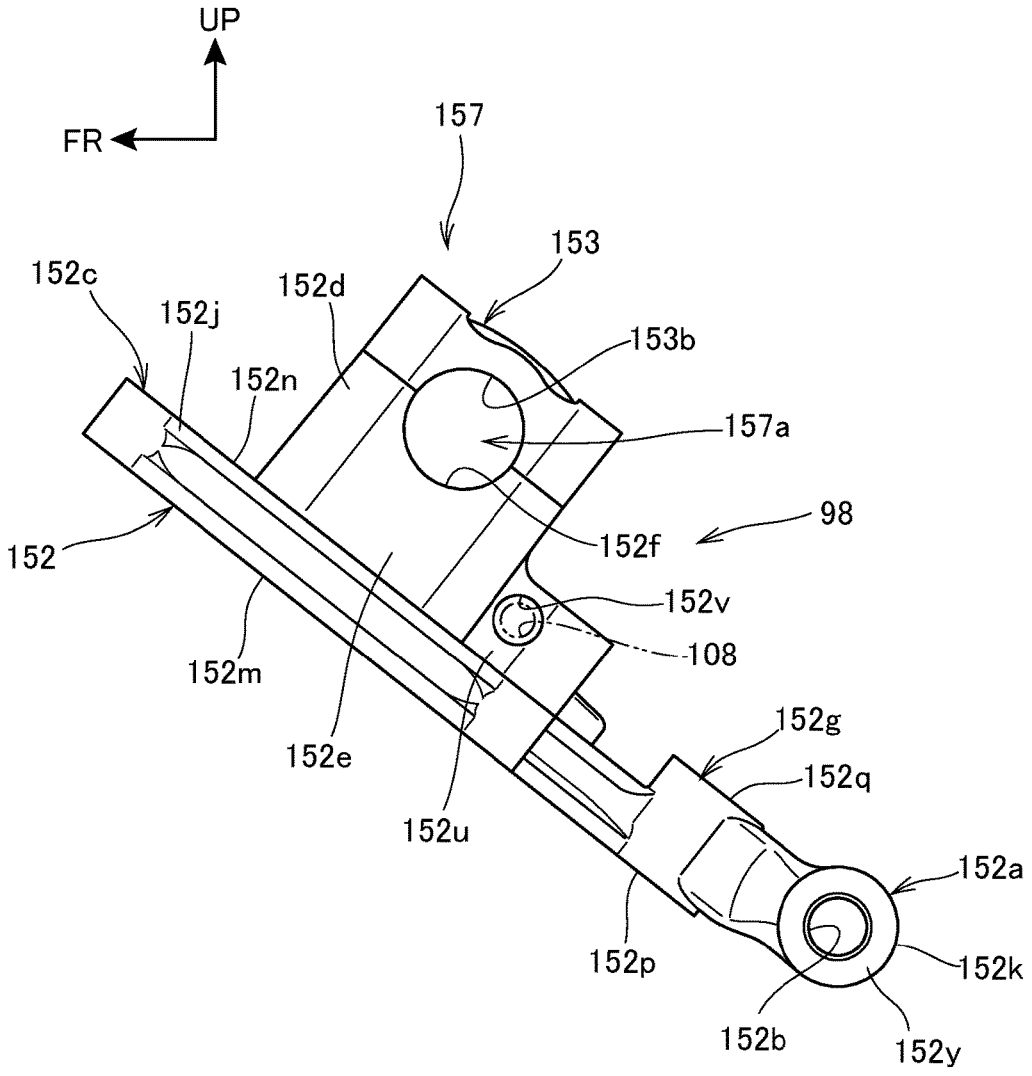
FIG. 8 is a side view showing the holder member.
Figure 9:
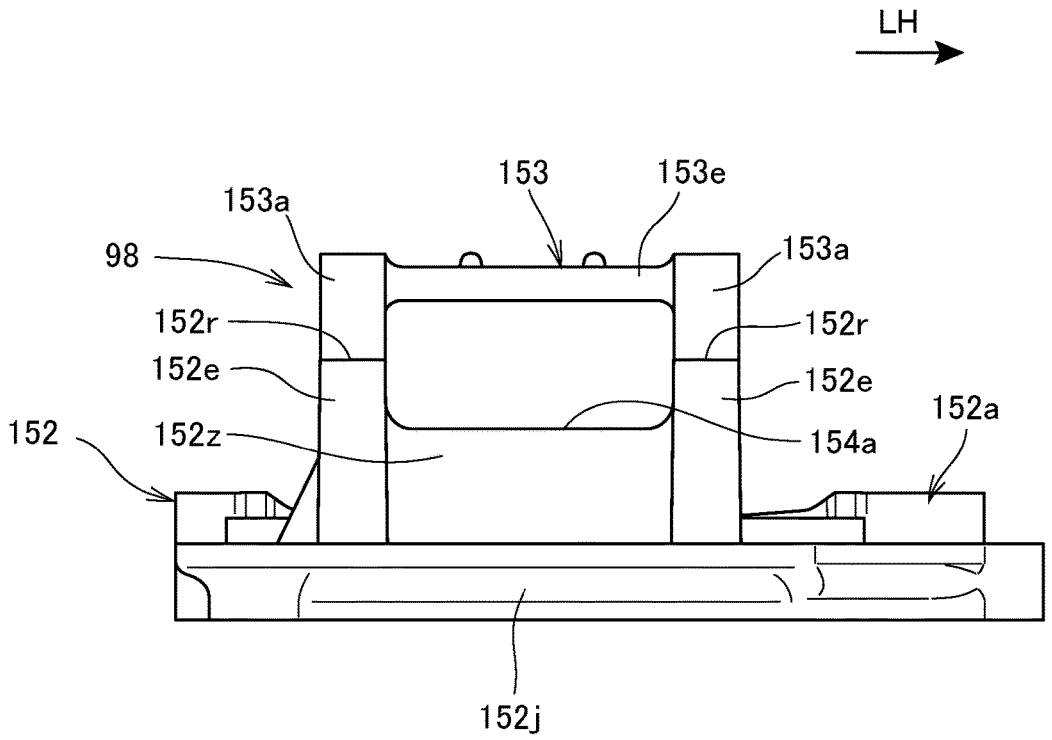
FIG. 9 is a front view showing the holder member.
Figure 10:
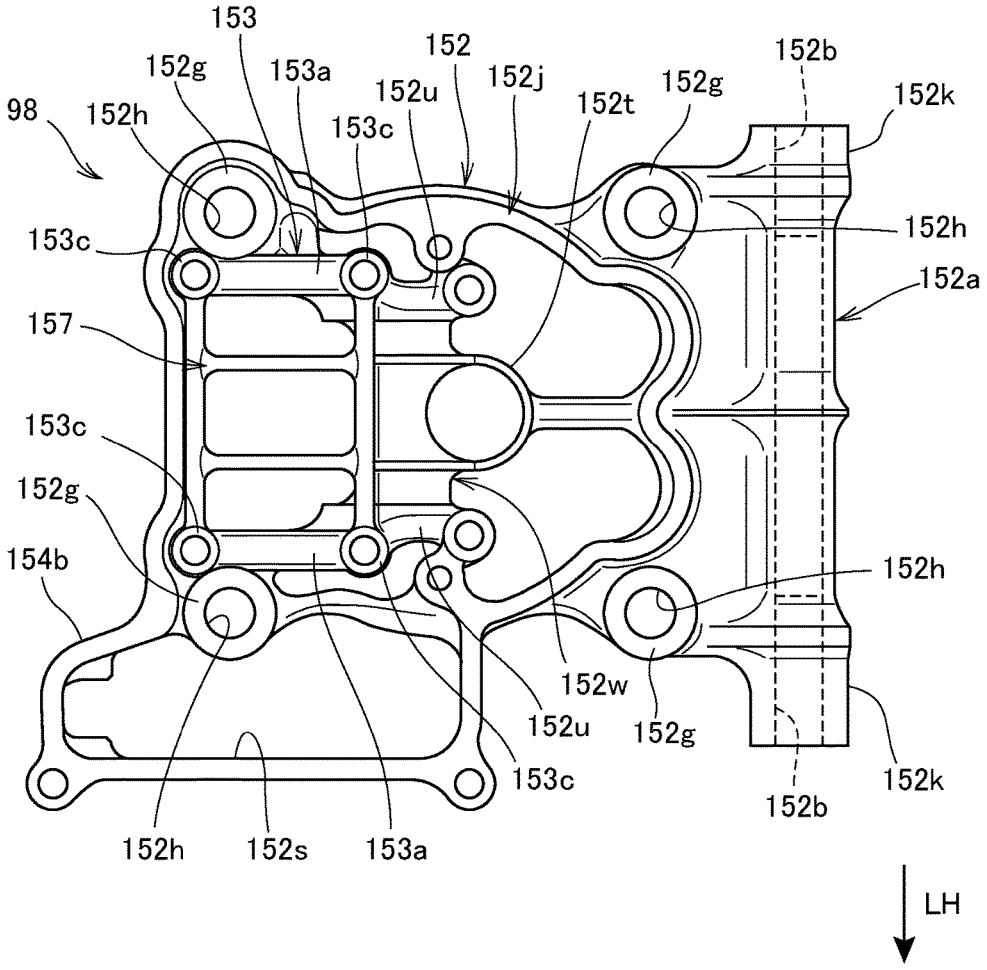
FIG. 10 is a plan view showing the holder member.

FIG. 8 is a side view showing the holder member 98. FIG. 9 is a front view showing the holder member 98. FIG. 10 is a plan view showing the holder member 98.

As shown in FIG. 8, the frame portion 152*j* of the front holder portion 152*c* has a lower surface 152*m* and an upper surface 152*n*. The lower surface 152*m* and the upper surface 152*n* are formed into a flat surface, and the lower surface 152*m* and the upper surface 152*n* are formed in parallel with each other. The upper surface of the rear cylinder head 97 (see FIG. 4) abuts on the lower surface 152*m* through a gasket, and the lower surface of the rear head cover 99 (see FIG. 4) abuts on the upper surface 152*n* through the gasket.

The raised portion 152*d* and the cap member 153 configure a camshaft supporting portion 157. The camshaft supporting portion 157 is formed with a camshaft fitting hole 157*a* by the notches 152*f* formed in the raised portion 152*d* and the notches 153*b* formed in the cap member 153. The camshaft fitting hole 157*a* is configured to rotatably fit the camshaft 104 therein. The raised portion 152*d* is provided with a pair of right and left rear side walls 152*u* extending rearward from the right and left side walls 152*e*. Shaft fitting holes 152*v* respectively extending in the vehicle width direction are opened in the right and left side walls 152*u*. The rocker arm shaft 108 is fitted into the right and left shaft fitting holes 152*v*.

Lower surfaces 152*p* of all the boss portions 152*g* of the holder body 152 are formed flush with the lower surface 152*m* of the frame portion 152*j*. Also, upper surfaces 152*q* of the pair of boss portions 152*g* of the plurality of boss portions 152*g* are formed higher than the upper surface 152*n* of the frame portion 152*j*, the pair of boss portions 152*g* being provided behind the front holder portion 152*c*. For this reason, it becomes possible to avoid interference of the bolts 101 (see FIG. 6) with the rear head cover 99 (see FIG. 3) attached to the holder member 98.

The internal combustion engine supporting portion 152*a* is hollowed in order to achieve a reduction in the entire weight thereof. The internal combustion engine supporting portion 152*a* has ends 152*k* formed into a cylindrical shape. The female screws 152*b* are bored in the ends 152*k* from end surfaces 152*y* of the ends 152*k*. The bolts 86 (see FIG. 2) are screwed into the female screws 152*b*.

As shown in FIG. 9, the right and left side walls 152*e*, 152*e* of the holder body 152 are connected to each other through a connecting wall 152*z*, the connecting wall 152*z* having an upper edge 154*a* formed lower than upper edges 152*r* of the side walls 152*e*, 152*e*. The right and left side walls 153*a*, 153*a* of the cap member 153 have respective upper portions connected to each other through a connecting portion 153*e*.

As shown in FIG. 10, the frame portion 152*j* of the holder body 152 has a front left portion formed with a laterally protruding portion 154*b* protruding leftward. The laterally protruding portion 154*b* has a frame-like inner side formed with a holder member chain insertion opening 152*s* for passage of the cam chain 113 (see FIG. 4). Also, the frame portion 152*j* is formed with a coupling portion 152*w* in the center in the longitudinal direction, the coupling portion 152*w* extending in the vehicle width direction and coupling the right and left rear side walls 152*u*, 152*u* to each other. The shaft fitting holes 152*v* (see FIG. 8) are opened in the coupling portion 152*w*, and also a ring portion 152*t* is formed in the center in the vehicle width direction of the coupling portion 152*w* in order to protrude rearward.

A plurality of boss portions 152*g* of the holder body 152 is provided to be positioned in four corners of a quadrangle. The camshaft supporting portion 157 having a rectangular shape in a plan view is arranged between the boss portions 152*g*, 152*g* arranged on the right and left sides, and the camshaft supporting portion 157 is arranged to the front portion of the holder body 152.

Figure 11B:
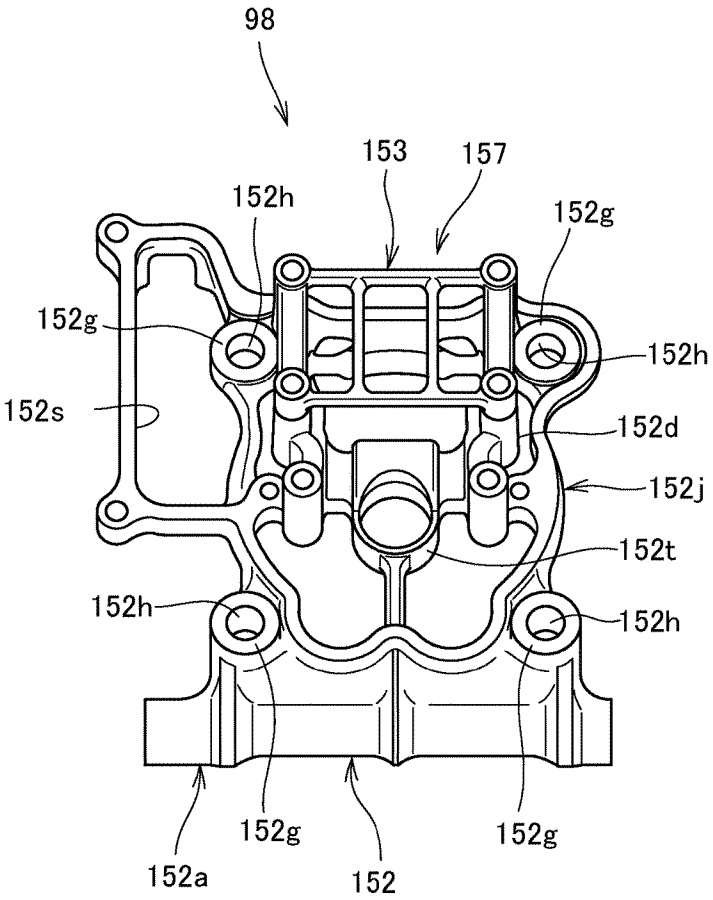
FIG. 11B is a perspective view showing the holder member.
Figure 11A:
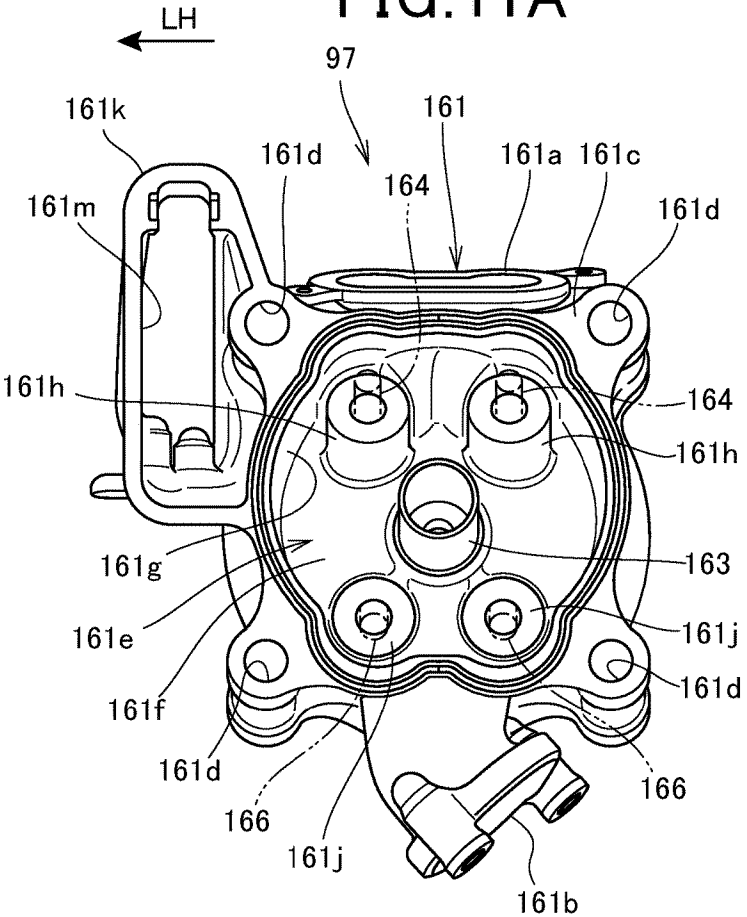
FIG. 11A is a perspective view showing a rear cylinder head.

FIG. 11A is a perspective view showing the rear cylinder head 97. FIG. 11B is a perspective view showing the holder member 98.

As shown in FIGS. 11A and 11B, the rear cylinder head 97 is provided with a cylinder head body 161 made of an aluminum alloy casting.

The cylinder head body 161 is provided with an intake device connection 161*a* and an exhaust pipe connection 161*b*. The intake device connection 161*a* is provided to connect the intake device 61 (see FIG. 5) to a front surface of the cylinder head body 161, and the exhaust pipe connection 161*b* is provided to a rear portion of the cylinder head body 161 for connecting the rear exhaust pipe 68 (see FIG. 3).

Also, the cylinder head body 161 is provide with an upper surface 161*c* abutting on the holder member 98 through the gasket. Bolt insertion holes 161*d* for passage of the bolts 101 (see FIG. 3) are opened in four corners of the upper surface 161*c*. A recessed portion 161*e* is formed in the center of the upper surface 161*c*.

The recessed portion 161*e* is configured with a bottom surface 161*f* and a peripheral surface 161*g* rising from a peripheral portion of the bottom surface 161*f*. The bottom surface 161*f* has the center attached with a pipe member 163. A pair of guide boss portions 161*h*, 161*h* is formed in front of the pipe member 163, and a pair of guide boss portions 161*j*, 161*j* is formed behind the pipe member 163.

The pipe member 163 forms a space for inserting a spark plug therein. The guide boss portions 161*h* on a front side are attached with valve guides for slidably supporting the intake engine valves 164. The guide boss portions 161*j* on a rear side are attached with valve guides for slidably supporting the exhaust engine valves 166.

The cylinder head body 161 has a left front portion provided with a head frame portion 161*k* formed long in the longitudinal direction. A head chain insertion opening 161*m* for passage of the cam chain 113 (see FIG. 4) is opened in the head frame portion 161*k*.

When the holder member 98 is assembled to the cylinder head body 161, the bolt insertion holes 161*d* and the bolt insertion holes 152*h*, and the head chain insertion opening 116*m* and the holder member chain insertion opening 152*s* are respectively matched with each other. With this assembly, the pipe member 163 is inserted into the ring portion 152*t* formed with respect to the frame portion 152*j* of the holder member 98, and the guide boss portions 161*h*, 161*h* and the guide boss portions 161*j*, 161*j* are arranged within the frame portion 152*j*.

Also, when the holder member 98 is assembled to the cylinder head body 161, the upper surface 161*c* of the cylinder head body 161 and the internal combustion engine supporting portion 152*a* of the holder member 98 do not overlap with each other.

Figure 12:
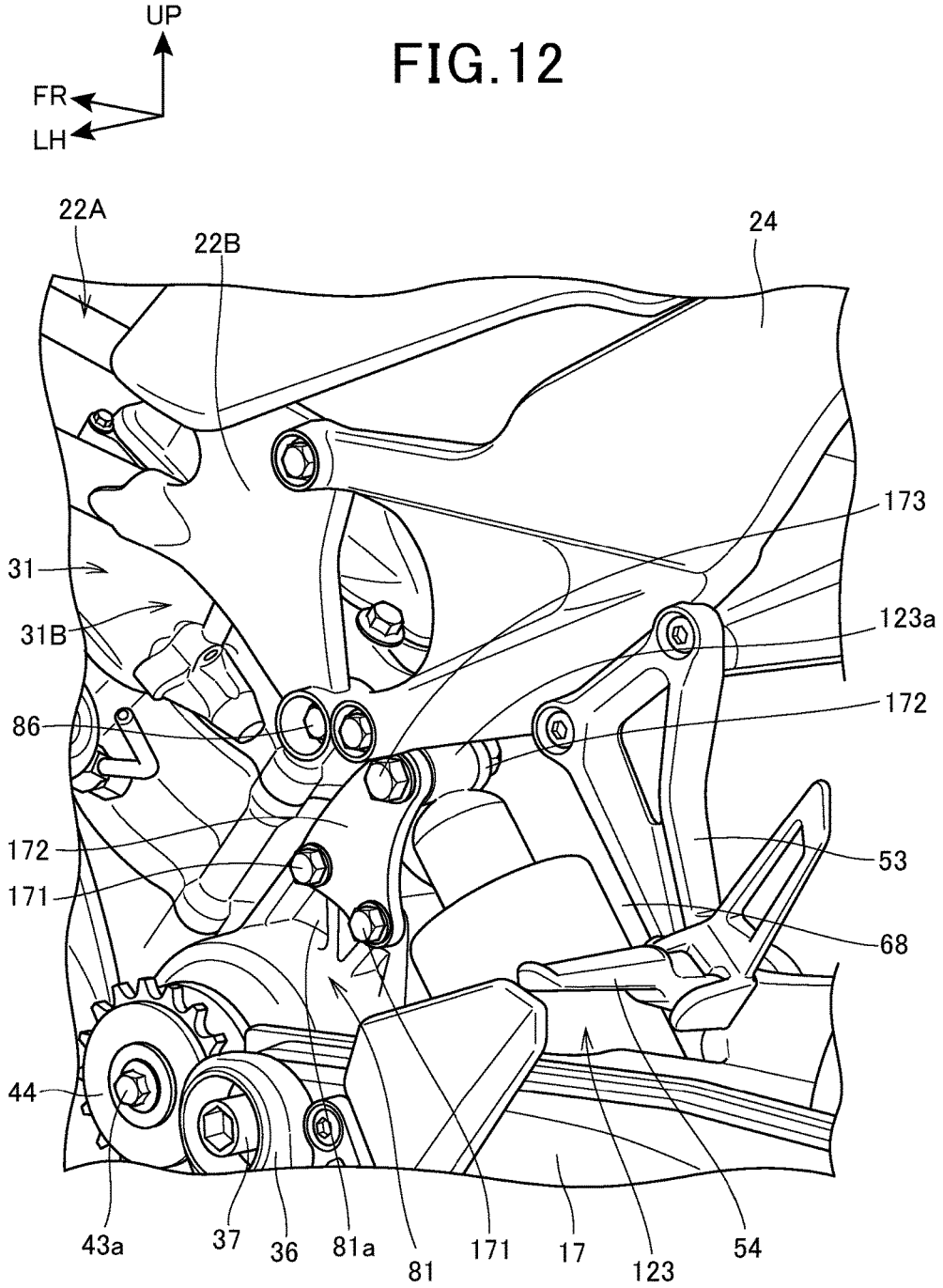
FIG. 12 is a perspective view showing the internal combustion engine, a cushion unit coupled to the internal combustion engine, and a periphery of the cushion unit.
Figure 13:
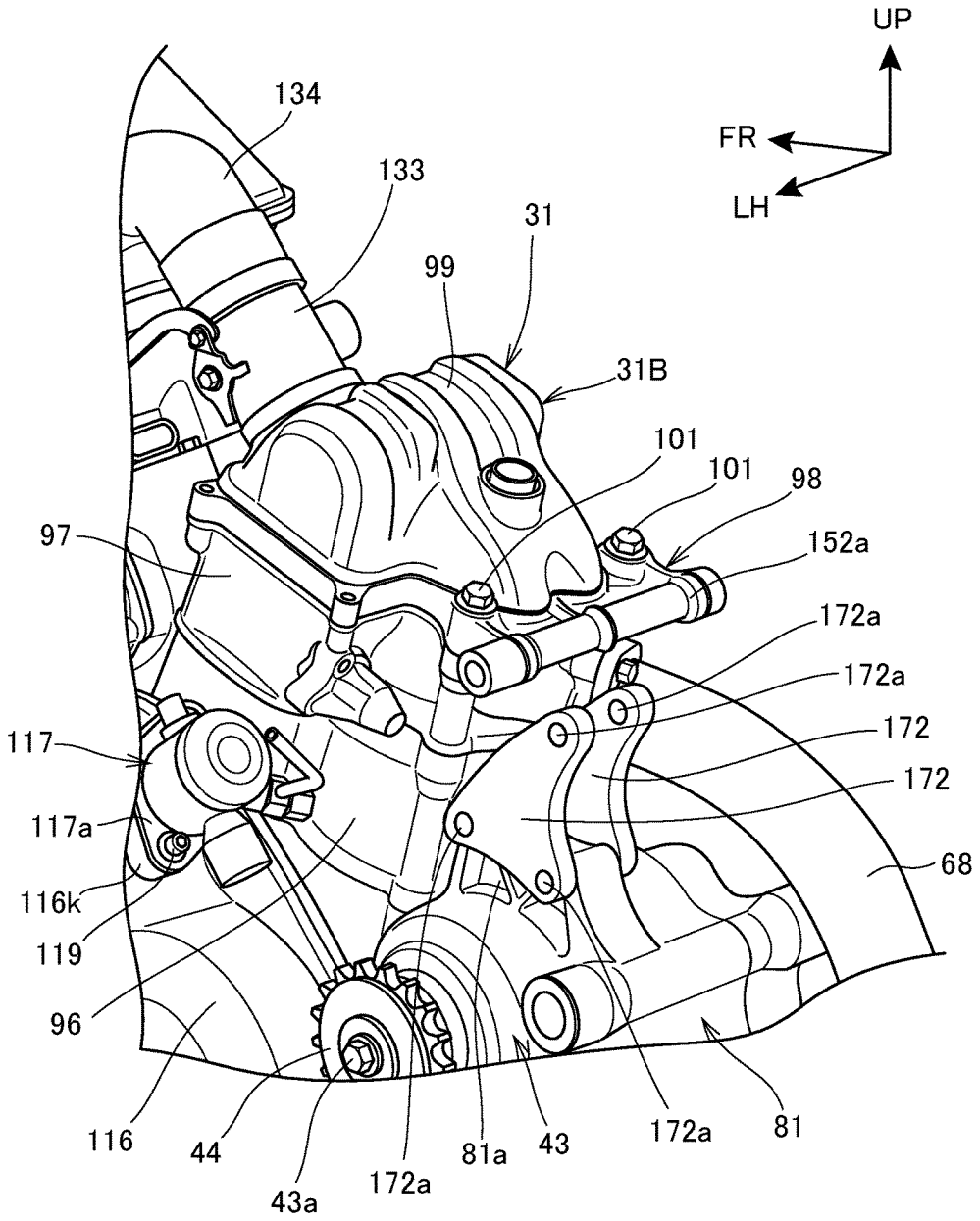
FIG. 13 is a perspective view showing a rear portion of the internal combustion engine.

FIG. 12 is a perspective view showing the internal combustion engine 31, the cushion unit 123 coupled to the internal combustion engine 31, and a periphery of the cushion unit 123. FIG. 13 is a perspective view showing a rear portion of the internal combustion engine 31.

As shown in FIG. 12 and FIG. 13, an upwardly protruding cushion upper end supporting portion 81*a* is formed integrally with the rear portion of the crankcase 81 positioned behind the rear bank 31B. A pair of right and left cushion brackets 172, 172 is attached to the upper portion of the cushion upper end supporting portion 81*a* by a plurality of bolts 171 while sandwiching the cushion upper end supporting portion 81*c* from the right and left sides. Further, an upper end 123*a* of the cushion unit 123 is coupled to the respective upper ends of the pair of right and left cushion brackets 172, 172 through a bolt 173.

The cushion brackets 172 are triangular plate members, and are provided with bolt insertion holes 172*a* opened in positions close to respective vertexes of the triangular shape. The bolts 171 are respectively inserted into the bolt insertion holes 172*a*, 172*a* on a lower side, and the bolt 173 is inserted into the bolt insertion hole 172*a* on an upper side.

The cushion unit 123 has a lower end coupled to the swing atm 17 and the pivot supporting member 36 through a link mechanism 175 (see FIG. 2), and absorbs and relaxes vibration transmitted from the rear wheel 13 (see FIG. 1) to the vehicle body through the swing arm 17.

Figure 14:
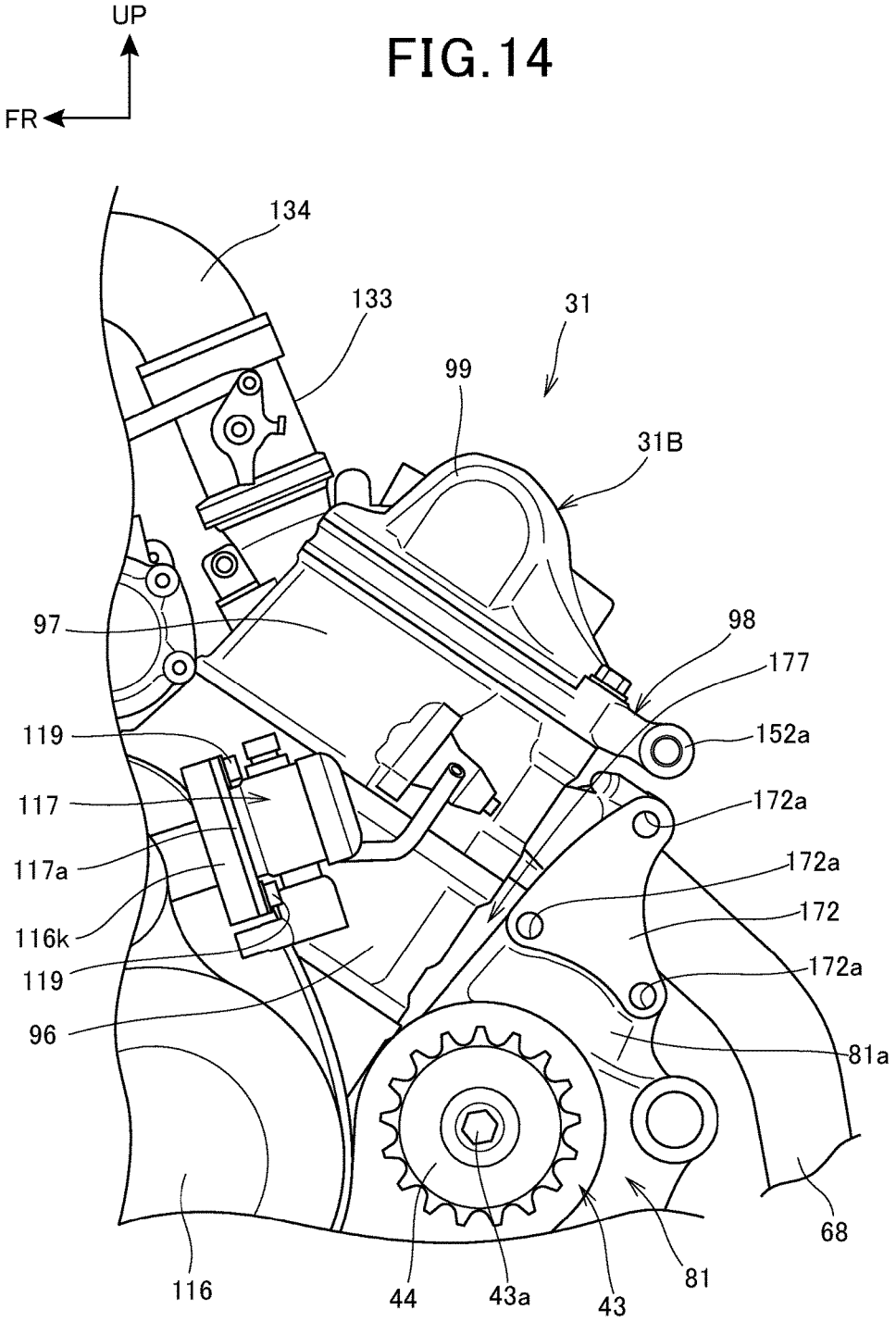
FIG. 14 is a left side view showing the rear portion of the internal combustion engine.

FIG. 14 is a left side view showing the rear portion of the internal combustion engine 31.

The cushion upper end supporting portion 81*a* is arranged upward and obliquely rearward of the drive sprocket 44 located behind the rear bank 31B and attached to the output shaft 43*a* of the transmission 43. Also, the upper end (detailedly, the bolt insertion hole 172*a*) of the cushion bracket 172 is arranged in a position in close proximity to a lower side of the holder member 98.

In this way, the cushion bracket 172 coupled to the cushion upper end supporting portion 81*a* and the cushion unit 123 (see FIG. 12) are provided in the space 177 formed behind the rear bank 31B and above the rear portion of the crankcase 81. For this reason, the space 177 for the vehicle body can be effective used, and the vehicle body can be compactly configured. Also, since the upper end of the cushion bracket 172 is arranged in the position in close proximity to the holder member 98, the vehicle body can be compactified, and also the stroke of the cushion unit 123 can be further increased. As a result, the vehicle riding comfortableness can be improved. Further, the internal combustion engine supporting portion 152*a* of the holder member 98 is formed to protrude rearward beyond the rear cylinder head 97, and the internal combustion engine supporting portion 152*a* is provided to be positioned in the space 177. For this reason, the space 177 can be further effectively used.

Figure 15:
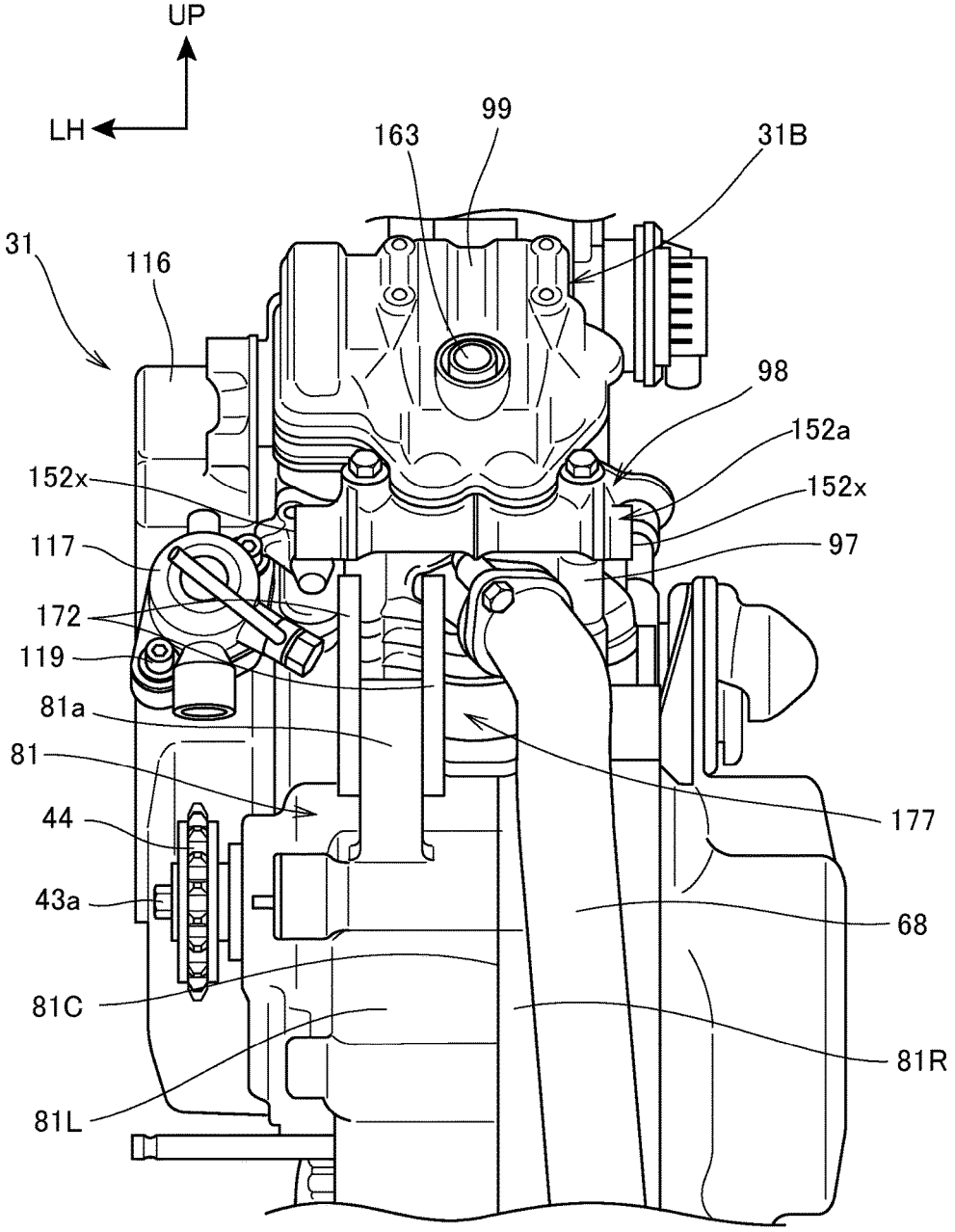
FIG. 15 is a rear view of the main section of the internal combustion engine.

FIG. 15 is a rear view of the main section of the internal combustion engine 31.

The crankcase 81 is configured with the left case 81L and the right case 81R cut in half in the vehicle width direction. A mating portion 81C between the left case 81L and the right case 81R is positioned substantially in the center of the crankcase 81 in the vehicle width direction. In the left case 81L, the cushion upper end supporting portion 81*a* is formed behind the rear bank 31B. In the right case 81R, the rear exhaust pipe 68 extending from the rear cylinder head 97 of the rear bank 31B is arranged above the right case 18R.

The cushion brackets 172, 172 and a part of the rear exhaust pipe 68 positioned lateral to the cushion brackets 172, 172 are positioned inward in the vehicle width direction in comparison with end surfaces 152*x*, 152*x* of both the ends of the internal combustion engine supporting portion 152*a* of the holder member 98.

As has been described above, the cushion upper end supporting portion 81*a* and the rear exhaust pipe 68 are arranged on the left and right sides in the space 177 behind the rear bank 31B. For this reason, the space 177 is effectively used.

As shown in above FIG. 4, and FIG. 6 to FIG. 8, the internal combustion engine 31 for the motorcycle 10 as the saddle-ride type vehicle includes the rear cylinder head 97 as the cylinder head, the rear cylinder head 97 being provided with the camshaft 104, the exhaust rocker arm 107 as the rocker arm rocked by the camshaft 104, the exhaust engine valve 166 as the engine valve closed/opened by being push-pressed by the exhaust rocker arm 107, and the rocker arm shaft 108 swingably supporting the exhaust rocker atm 107. In the internal combustion engine 31 for the motorcycle 10 as the saddle-ride type vehicle, the holder member 98 is provided separately from the rear cylinder head 97 and is provided adjacently to the rear cylinder head 97, the camshaft 104 is rotatably supported by the holder member 98, and the holder member 98 is provided with the right and left rear side walls 152*u* and the internal combustion engine supporting portion 152*a*, the right and left rear side walls 152*u* serving as the rocker arm shaft supporting portions for supporting the rocker arm shafts 108, the internal combustion engine supporting portion 152*a* being supported by the vehicle body frame 11.

With this structure, in the motorcycle 10 having the limited vehicle body space in comparison with the automobile, the holder member 98 is provided separately from the rear cylinder head 97. For this reason, the rear cylinder head 97 can be formed into a simple shape by displacing to the holder member 98 the camshaft supporting portion, the rocker arm shaft supporting portion and the internal combustion engine supporting portion, the camshaft supporting portion and the rocker arm shaft supporting portion being provided to the cylinder head of the existing internal combustion engine, the internal combustion engine supporting portion being provided to the internal combustion engine. Also, the holder member 98 is provided only with the camshaft supporting portion 157 as the supporting portion for the camshaft 104, the right and left rear side walls 152*u*, 152*u* as the rocker arm shaft supporting portions, the internal combustion engine supporting portion 152*a* and the like. As a result, the structure of the holder member 98 is prevented from being complicated, and the holder member 98 can be easily formed. Also, the holder member 98 can be configured to effectively use the vehicle body space (for example, the internal combustion engine supporting portion 152*a* is arranged in the space 177 (see FIG. 14) behind the rear bank 31B). In view of this, the assemblability of the rear cylinder head 97 and the productivity of the rear cylinder head 97 and the holder member 98 and, eventually, the assemblability and the productivity of the internal combustion engine 31 can be improved.

Also, as shown in FIG. 2, FIG. 4, and FIG. 10, the internal combustion engine supporting portion 152*a* is provided to extend outward in the vehicle width direction, and the internal combustion engine supporting portion 152*a* is fastened to the vehicle body frame 11 from the outside in the vehicle width direction toward the inside in the vehicle width direction by the bolts 86 as the fastening members. For this reason, the internal combustion engine supporting portion 152*a* can be fastened to the vehicle body frame 11 from the outside in the vehicle width direction, and the assemblability of the internal combustion engine 31 with respect to the vehicle body frame 1 can be improved.

Also, as shown in FIG. 12 to FIG. 14, the crankcase 81 is provided below the rear cylinder head 97, and the crankcase 81 is provided with the cushion upper end supporting portion 81*a* supporting the upper end 123*a* of the cushion unit 123 through the brackets 172, 172. For this reason, the cushion unit 123 can be supported by effectively using the vehicle body space around the internal combustion engine 31.

Also, as shown in FIG. 15, the crankcase 81 is cut in half in the vehicle width direction, and the cushion upper end supporting portion 81*a* is provided to one of the left case 81L and the right case 81R as the right and left crankcases. The known internal combustion engine is configured in such a manner that the cushion upper end supporting portions are provided on both the right and left sides of the crankcases cut in half in the vehicle width direction. The known internal combustion engine has the advantage that the cushion unit supporting portion can be arranged in the center of the vehicle body. However, dimensional control when assembling the cushion unit to the cushion upper end supporting portions becomes difficult. On the other hand, in the embodiment, by providing the cushion upper end supporting portion 81*a* to one of the left case 81L and the right case 81R cut in half in the vehicle width direction, the dimensional control when assembling the cushion unit 123 can be easily performed, and also the vehicle body space of the other of the left case 81L and the right case 81R cut in half in the vehicle width direction can be effectively used.

Also, the rear exhaust pipe 68 as the exhaust pipe is connected to the rear portion of the rear cylinder head 97, and the rear exhaust pipe 68 extends rearward of the other of the left case 81L and the right case 81R. For this reason, the cushion unit 123 is coupled to the cushion upper end supporting portion 81*a* of one of the left case 81L and the right case 81R, and the rear exhaust pipe 68 passes behind the other of the left case 81L and the right case 81R. As a result, the space around the internal combustion engine 31 for the motorcycle 10 having the limited vehicle body space can be effectively used.

Also, as shown in FIG. 4, the internal combustion engine 31 is the V-type internal combustion engine including the front bank 31A and the rear bank 31B. The rear cylinder head 97 and the cushion upper end supporting portion 81*a* are provided to the rear bank 31B. For this reason, when the upper end 123*a* of the cushion unit 123 is attached to the cushion upper end supporting portion 81*a*, the lower end of the cushion unit 123 can be easily attached to the side of the rear wheel 13 (see FIG. 1), and the assemblability of the cushion unit 123 can be improved.

Also, the supercharger 63 is arranged between the front bank 31A and the rear bank 31B. For this reason, the space around the internal combustion engine 31 for the motorcycle 10 having the limited vehicle body space can be effectively used.

Also, as shown in FIG. 12 and FIG. 14, the internal combustion engine supporting portion 152*a* is provided at the rear end of the holder member 98, and the upper end 123*a* of the cushion unit 123 is arranged immediately below the internal combustion engine supporting portion 152*a*. For this reason, by arranging the internal combustion engine supporting portion 152*a* in the space 177 below and behind the rear cylinder head 97, effective use can be achieved. Also, the upper end 123*a* of the cushion unit 123 is arranged immediately below the internal combustion engine supporting portion 152*a*. For this reason, the stroke of the cushion unit 123 can be further increased, and the vehicle riding comfortableness can be improved.

The above-described embodiment absolutely presents one embodiment of the present invention. Various design modification and application may be optionally made within the scope not departing from the gist of the present invention.

For example, in the above-described embodiment, as shown in FIG. 6 and FIG. 8, the holder member 98 is provided with the pair of right and left rear side walls 152*u*, 152*u* as the supporting portions for the rocker arm shafts 108 supporting the exhaust rocker arms 107. However, in the case that the intake rocker arm is provided to the valve train 151, the holder member 98 may be provided with the rocker arm shaft supporting portion for supporting the intake rocker arm.

The present invention is not limited to the case applied to the motorcycle 10, and the present invention can be applied to also the saddle-ride type vehicles including vehicles excluding the motorcycle 10. Note that the saddle-ride type vehicles are vehicles including the general vehicles with a rider striding over the vehicle body, and including not only the motorcycle 10 (including motorized bicycles) but also including three-wheeled vehicles and four-wheeled vehicles classified into ATVs (All Terrain Vehicles).

REFERENCE SIGNS LIST

10 . . . Motorcycle (saddle-ride type vehicle)
11 . . . Vehicle body frame
31 . . . Internal combustion engine
31A . . . Front bank
31B . . . Rear bank
63 . . . Supercharger
68 . . . Rear exhaust pipe (exhaust pipe)
81 . . . Crankcase
81*a* . . . Cushion upper end supporting portion
81L, 81R . . . Left and right crankcases
86 . . . Bolt (fastening member)
92 . . . Front cylinder head (cylinder head)
97 . . . Rear cylinder head (cylinder head)
98 . . . Holder member
104 . . . Camshaft
107 . . . Exhaust rocker arm (rocker arm)
108 . . . Rocker arm shaft
152*a* . . . Internal combustion engine supporting portion
152*u* . . . Rear side wall (rocker arm shaft supporting portion)
166 . . . Exhaust engine valve (engine valve)
172 . . . Cushion bracket (bracket)

The invention claimed is:

1. An internal combustion engine for a saddle-ride type vehicle, the internal combustion engine comprising:

a cylinder head (97), the cylinder head (97) including a camshaft (104), a rocker arm (107) rocked by the camshaft (104), an engine valve (166) closed/opened by being push-pressed by the rocker arm (107), and a rocker arm shaft (108) swingably supporting the rocker arm (107), wherein the cylinder head (97) is provided separately from a holder member (98), and the holder member (98) being provided adjacently to the cylinder head (97), the camshaft (104) is rotatably supported by the holder member (98), and the holder member (98) includes a rocker arm shaft supporting portion (152*u*) and an internal combustion engine supporting portion (152*a*), the rocker arm shaft supporting portion (152*u*) supporting the rocker arm shaft (108), the internal combustion engine supporting portion (152*a*) being supported by a vehicle body frame (11).

2. The internal combustion engine for a saddle-ride vehicle according to claim 1, wherein the internal combustion engine supporting portion (152*a*) is provided to extend outward in a vehicle width direction, and the internal combustion engine supporting portion (152*a*) is fastened to the vehicle body frame (11) from an outside in the vehicle width direction toward an inside in the vehicle width direction by a fastening member (86).

3. The internal combustion engine for a saddle-ride vehicle according to claim 2, wherein a crankcase (81) is provided below the cylinder head (97), and the crankcase (81) is provided with a shock absorber upper end supporting portion (81*a*) supporting an upper end of a shock absorber unit (123) through a bracket (172).

4. The internal combustion engine for a saddle-ride vehicle according to claim 1, wherein a crankcase (81) is provided below the cylinder head (97), and the crankcase (81) is provided with a shock absorber upper end supporting portion (81*a*) supporting an upper end of a shock absorber unit (123) through a bracket (172).

5. The internal combustion engine for a saddle-ride vehicle according to claim 4, wherein the crankcase (81) is cut in half in a vehicle width direction, and the shock absorber upper end supporting portion (81*a*) is provided to one of right and left crankcases (81R, 81L).

6. The internal combustion engine for a saddle-ride vehicle according to claim 5, wherein an exhaust pipe (68) is connected to a rear portion of the cylinder head (97), and the exhaust pipe (68) extends rearward of a remaining one of the right and left crankcases (81R, 81L).

7. The internal combustion engine for a saddle-ride vehicle according to claim 6, the internal combustion engine being a V-type internal combustion engine comprising a front bank (31A) and a rear bank (31B), wherein the cylinder head (97) and the shock absorber upper end supporting portion (81*a*) are provided to the rear bank (31B).

8. The internal combustion engine for a saddle-ride vehicle according to claim 6, wherein the internal combustion engine supporting portion (152*a*) is provided at a rear end of the holder member (98), and the upper end of the shock absorber unit (123) is arranged immediately below the internal combustion engine supporting portion (152*a*).

9. The internal combustion engine for a saddle-ride vehicle according to claim 5, the internal combustion engine being a V-type internal combustion engine comprising a front bank (31A) and a rear bank (31B), wherein the cylinder head (97) and the shock absorber upper end supporting portion (81*a*) are provided to the rear bank (31B).

10. The internal combustion engine for a saddle-ride vehicle according to claim 5, wherein the internal combustion engine supporting portion (152*a*) is provided at a rear end of the holder member (98), and the upper end of the shock absorber unit (123) is arranged immediately below the internal combustion engine supporting portion (152*a*).

11. The internal combustion engine for a saddle-ride vehicle according to claim 4, the internal combustion engine being a V-type internal combustion engine comprising a front bank (31A) and a rear bank (31B), wherein the cylinder head (97) and the shock absorber upper end supporting portion (81*a*) are provided to the rear bank (31B).

12. The internal combustion engine for a saddle-ride vehicle according to claim 11, wherein a supercharger (63) is arranged between the front bank (31A) and the rear bank (31B).

13. The internal combustion engine for a saddle-ride vehicle according to claim 12, wherein the internal combustion engine supporting portion (152*a*) is provided at a rear end of the holder member (98), and the upper end of the shock absorber unit (123) is arranged immediately below the internal combustion engine supporting portion (152*a*).

14. The internal combustion engine for a saddle-ride vehicle according to claim 11, wherein the internal combustion engine supporting portion (152*a*) is provided at a rear end of the holder member (98), and the upper end of the shock absorber unit (123) is arranged immediately below the internal combustion engine supporting portion (152*a*).

15. The internal combustion engine for a saddle-ride vehicle according to claim 4, wherein the internal combustion engine supporting portion (152*a*) is provided at a rear end of the holder member (98), and the upper end of the shock absorber unit (123) is arranged immediately below the internal combustion engine supporting portion (152*a*).

* * * * *